US007305193B2

(12) United States Patent
Nishimura

(10) Patent No.: US 7,305,193 B2
(45) Date of Patent: Dec. 4, 2007

(54) IMAGE FORMING APPARATUS WITH OPERATION MODES

(75) Inventor: Soichiro Nishimura, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 246 days.

(21) Appl. No.: 11/151,462

(22) Filed: Jun. 14, 2005

(65) Prior Publication Data

US 2005/0281569 A1 Dec. 22, 2005

(30) Foreign Application Priority Data

Jun. 16, 2004 (JP) ..... 2004-178514

(51) Int. Cl.

| | |
|---|---|
| ***G03G 15/00*** | (2006.01) |
| ***G03G 15/043*** | (2006.01) |
| ***G03G 15/06*** | (2006.01) |
| ***G03G 15/16*** | (2006.01) |
| ***G03G 15/20*** | (2006.01) |

(52) U.S. Cl. ..... 399/31; 399/51; 399/55; 399/66; 399/69

(58) Field of Classification Search ..... 399/31, 399/51, 66, 69

See application file for complete search history.

(56) References Cited

U.S. PATENT DOCUMENTS

| | | | | |
|---|---|---|---|---|
| 6,404,998 | B1 * | 6/2002 | Tanaka et al. | 399/66 |
| 6,542,703 | B1 * | 4/2003 | Jung | 399/66 |
| 7,050,732 | B2 * | 5/2006 | Bae et al. | 399/66 |
| 7,062,186 | B2 * | 6/2006 | Kyung | 399/66 |
| 7,120,367 | B2 * | 10/2006 | Kyung et al. | 399/66 |

FOREIGN PATENT DOCUMENTS

| | | |
|---|---|---|
| JP | 2000-221810 | 8/2000 |
| JP | 2002-014551 | 1/2002 |
| JP | 2003-295636 | 10/2003 |

* cited by examiner

*Primary Examiner*—William J. Royer
(74) *Attorney, Agent, or Firm*—Banner & Witcoff, Ltd

(57) ABSTRACT

An image forming apparatus is provided which can form an image without defective transfer even if a resistance value of a transfer device is so high that defective transfer tends to occur. Before starting operation of printing an image on a sheet, a transfer current is passed to a transfer roller so as to detect a voltage value V of a transfer voltage. When it is determined that the detected voltage value V does not exceed a reference voltage value Vr (resistance value of the transfer roller does not exceed a reference limiting value), an operation mode of the printing operation is set to a first printing mode. When it is determined that the detected voltage value V exceeds a reference voltage value Vr (resistance value of the transfer roller exceeds a reference limiting value), the operation mode of the printing operation is set to a second printing mode.

15 Claims, 18 Drawing Sheets

IMAGE FORMING APPARATUS WITH OPERATION MODES

CROSS-REFERENCE TO RELATED APPLICATIONS

This application claims the benefit of Japanese Patent Application No. 2004-178514 filed Jun. 16, 2004 in the Japan Patent Office, the disclosure of which is incorporated herein by reference.

BACKGROUND

This invention relates to an image forming apparatus that performs an image forming operation for forming an image on a recording medium.

Heretofore, a known image forming apparatus transfers a toner image formed on the surface of a photosensitive drum onto a sheet, using a transfer roller to which a transfer voltage is applied.

In such an image forming apparatus, the transfer voltage is applied to the transfer roller by either constant current control or constant voltage control. However, there is an image forming apparatus in which the type of application of the transfer voltage is switched between constant voltage control and constant current control, depending on a resistance value of the transfer roller, as disclosed in Unexamined Japanese Patent Publication No. 2000-2218 10, for example.

SUMMARY

As a resistance value of a transfer roller is increased because of long-term use an image forming apparatus is susceptible to defective transfer. That is, in the case of constant current control, the higher the resistance value of the transfer roller, the higher the voltage value of the transfer voltage is required for passing a transfer current having a predetermined current value. As a result, defective transfer due to electric discharge generated between the transfer roller and a sheet tends to occur. On the other hand, in the case of constant voltage control, the higher the resistance value of the transfer roller, the lower the current value of the transfer current is passed when the transfer voltage having a predetermined voltage value is applied. As a result, defective transfer due to insufficient transfer for lack of the transfer current tends to occur. Therefore, when the resistance value of the transfer roller becomes so high that defective transfer may occur, it is necessary to replace the transfer roller immediately.

One object of the present invention is to provide an image forming apparatus that can perform an image forming operation without defective transfer even if a resistance value of a transfer device becomes so high as to cause defective transfer.

In order to attain the above and other objects, one aspect of the present invention provides an image forming apparatus that performs an image forming operation for forming an image on a recording medium, comprising: a photosensitive body; a charging device that charges a surface of the photosensitive body; an exposing device that exposes the surface of the photosensitive body charged by the charging device so as to form an electrostatic latent image; a developing device that develops, using developer, the electrostatic latent image formed on the surface of the photosensitive body by the exposing device so as to form a developer image (a visual image formed by the developer); a transfer device that transfers the developer image formed by the developing device onto the recording medium; a transfer controller that applies a transfer voltage to the transfer device so that a transfer current is passed to transfer the developer image onto the recording medium; a resistance determiner that determines whether a resistance value of the transfer device exceeds a predetermined reference limiting value; and an operation mode switcher that switches an operation mode of the image forming operation, when it is determined by the resistance determiner that the resistance value of the transfer device exceeds the reference limiting value, from a first image forming mode that is the operation mode before it is determined that the resistance value exceeds the reference limiting value, to a second image forming mode that provides better protection against defective transfer by the transfer device than the first image forming mode.

In other words, in the present image forming apparatus, when the resistance value of the transfer device is so high that defective transfer by the transfer device may occur, the operation mode of the image forming operation is switched.

Accordingly, in the present image forming apparatus, even if the resistance value of the transfer device has reached so high as to cause defective transfer because of long-term use, the image forming operation can be performed without defective transfer. That is, as the resistance value of the transfer device is increased, the voltage value of the transfer voltage required for passing a constant transfer current is also increased so that electric discharge may be generated between the transfer device and the recording medium, or the current value of the transfer current passed by application of a constant transfer voltage is decreased so that the transfer of the developer image may be insufficient. As a result, defective transfer by the transfer device tends to occur. However, in the present image forming apparatus, since the operation mode of the image forming operation is switched when the resistance value of the transfer device exceeds the reference limiting value, the image forming operation can be performed without defective transfer by the transfer device.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
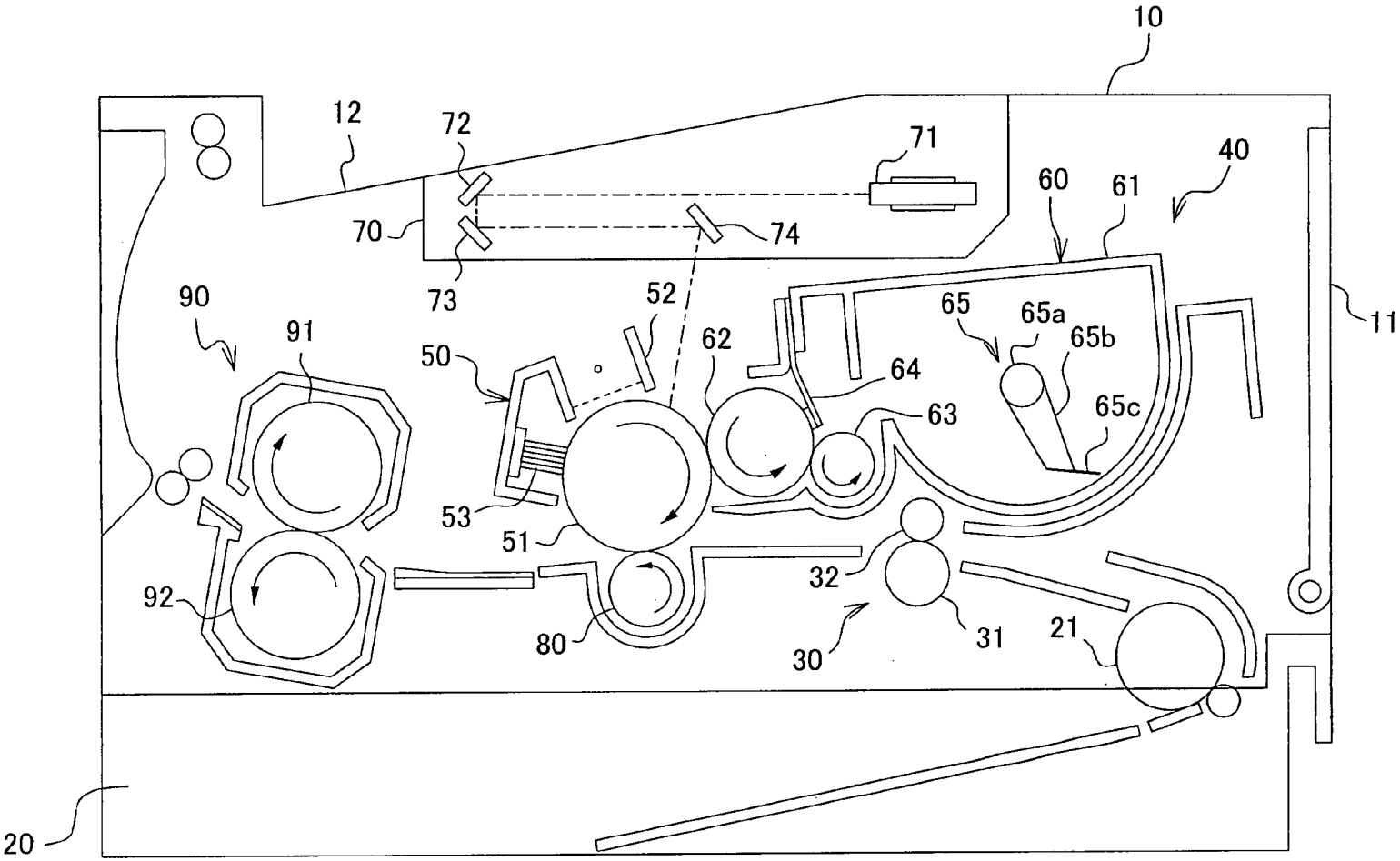
FIG. 1 is a schematic sectional side view of a laser printer according to a first embodiment of the present invention.

Referring to FIG. 1, in a body casing 10 of a laser printer of the present embodiment, there are provided a feed tray 20, a feed roller 21, a pair of conveying rollers 30, a process cartridge 40, a scanner unit 70, a transfer roller 80, and a fixing device 90.

The feed tray 20 is for loading a stack of sheets as recording media therein. The feed tray 20 is fitted to a bottom part inside the body casing 10 in a detachable manner.

The feed roller 21 is provided on the front side (the right side in FIG. 1) of the laser printer above the feed tray 20. The feed roller 21 is rotationally driven by a later-described motor 131 (see FIG. 3) so as to take out the sheets set in the feed tray 20 one by one to be sent to the pair of conveying rollers 30.

The conveying rollers 30 are for clipping and conveying a sheet in a sheet conveying path. The conveying rollers 30 are composed of a resist roller 31 and a pinch roller 32. The resist roller 31 and the pinch roller 32 are disposed in a state pressed against each other. As the resist roller 31 is rotationally driven by the later-described motor 131 (see FIG. 3), the pinch roller 32 is also rotated being driven by the resist roller 31. As a result of the drive of the conveying rollers 30, the front edge of the sheet conveyed from the feed roller 21 is aligned, and the sheet is sent to a transfer region (a contact region between a later-described photosensitive drum 51 and the transfer roller 80).

Figure 2:
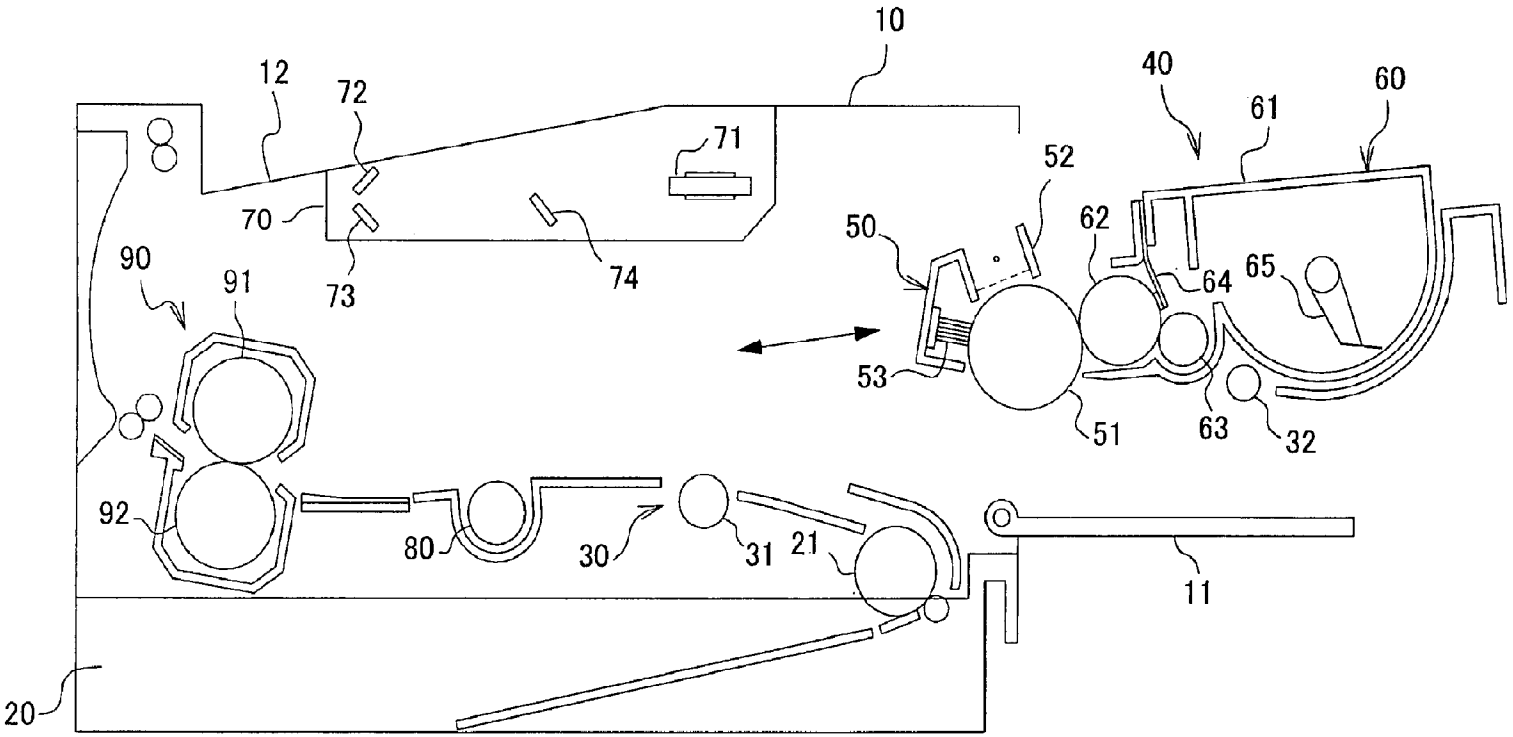
FIG. 2 is a schematic sectional side view of the laser printer with its cover opened.

The process cartridge 40 is fitted to the body casing 10 in a detachable manner. That is, a cover 11 that can be opened and closed is provided on the front side (the right side in FIG. 1) of the body casing 10, and, as shown in FIG. 2, the process cartridge 40 can be attached to and detached from the body casing 10 with the cover 11 in an open state. Also, the process cartridge 40 used in the laser printer of the present embodiment is composed of a photosensitive body cartridge 50 and a developing cartridge 60. The developing cartridge 60 is designed to be attached to and detached from the photosensitive body cartridge 50.

The photosensitive body cartridge 50 includes the photosensitive drum 51, a scorotron charger 52, and a paper dust removing brush 53.

The photosensitive drum 51 includes a drum body made of a metal pipe (e.g., aluminum), the surface of which is coated by a positively charged photosensitive layer made of an organic photosensitive body consisting mainly of polycarbonate. The drum body is earthed. Also the photosensitive drum 51 is rotatably supported by a casing of the photosensitive body cartridge 50. The photosensitive drum 51 is rotationally driven by the later-described motor 131 (see FIG. 3) in a direction in which the sheet sent from the conveying rollers 30 is conveyed toward the fixing device 90 (i.e., clockwise in FIG. 1).

The scorotron charger 52 is provided upstream of a later-described developing roller 62 in a rotation direction of the photosensitive drum 51, with a predetermined interval so as not to contact the surface of the photosensitive drum 51. The scorotron charger 52 is a charger for positive charging that generates corona discharge from a charging wire such as tungsten.

The paper dust removing brush 53 is provided downstream of the transfer roller 80 in a rotation direction of the photosensitive drum 51 and upstream of the scorotron charger 52, so as to contact the surface of the photosensitive drum 51. The paper dust removing brush 53 removes paper dust adhered to the surface of the photosensitive drum 51.

In a casing 61 that can be detachably attached to the photosensitive body cartridge 50, the developing cartridge 60 includes the developing roller 62, a supply roller 63, a layer thickness control blade 64, and an agitator 65.

Inside the casing 61, toner as a developer is stored. In the laser printer of the present embodiment, positively charged, non-magnetic one-component polymerized toner is used. In order to produce this toner, styrene-acrylic resin formed into a sphere particle by a known polymerization method such as suspension polymerization, a coloring agent, a charge control agent, and a wax are dispensed to form a toner mother particle. An external additive is further added thereto.

The developing roller 62 has a metal roller shaft coated with a roller made of conductive elastic material (e.g., rubber), and is provided to face and contact the photosensitive drum 51 through an opening formed on the casing 61. Also, the developing roller 62 is rotatably supported by the casing 61, and rotationally driven by the later-described motor 131 (see FIG. 3) so as to move in the same direction as the photosensitive drum 51 (i.e., so as to rotate in a direction opposite to the photosensitive drum 51) at a nip portion where the developing roller 62 faces and contacts the photosensitive drum 51. A developing bias is also applied to the developing roller 62.

The supply roller 63 has a metal roller shaft coated with a roller made of conductive sponge material, and is disposed in a state pressed against the developing roller 62 inside the casing 61. Also, the supply roller 63 is rotatably supported by the casing 61, and rotationally driven by the later-described motor 131 (see FIG. 3) so as to move in a direction opposite to the developing roller 62 (i.e., so as to rotate in the same direction as the developing roller 62) at a nip portion where the supply roller 63 faces and contacts the developing roller 62.

The layer thickness control blade 64 includes a blade body composed of a metal leaf spring. A tip portion of the blade body is provided with a pressing portion having a semi-circular cross section made of insulating silicone rubber. One end of the blade body is supported to the casing 61, and the pressing portion on the other end is pressed against the surface of the developing roller 62 by an elastic force of the blade body.

The agitator 65 is provided with a rotation shaft 65*a*, an agitator member 65*b* extending in a radial direction from the rotation shaft 65*a*, and a scraping member 65*c* composed of a flexible film provided at a free end part of the agitator member 65*b*. The rotation shaft 65*a* is rotationally driven by the later-described motor 131 (see FIG. 3). Along with the rotation of the rotation shaft 65*a*, the agitator member 65*b* which is integrally provided with the rotation shaft 65*a* is rotated in a peripheral direction, and the scraping member 65*c* uniformly agitates the toner inside the casing 61.

The scanner unit 70 is provided with a laser emitter (not shown), a polygon mirror 71, a lens (not shown), and reflection mirrors 72, 73, and 74. The scanner unit 70 irradiates a laser beam emitted from the laser emitter based on image data to the surface of the photosensitive drum 51 by rapid scanning.

The transfer roller 80 is an ionic conductive transfer roller, having a metal shaft coated with a roller made of ionic conductive elastic material (e.g., rubber). The transfer roller 80 is disposed below the photosensitive drum 51 in a state pressed against the photosensitive drum 51. The transfer roller 80 is rotationally driven by the later-described motor 131 (see FIG. 3) so as to move in the same direction as the photosensitive drum 51 (i.e., so as to rotate in a direction opposite to the photosensitive drum 51) at a nip portion where the transfer roller 80 faces and contacts the photosensitive drum 51. A transfer voltage (transfer bias) is also applied to the transfer roller 80.

The fixing device 90 is provided with a heating roller 91, and a pressing roller 92. The heating roller 91 is made of metal such as aluminum formed into a cylindrical shape. The heating roller 91 is rotationally driven by the later-described motor 131 (see FIG. 3) so as to move in the same direction as the sheet (i.e., so as to rotate clockwise) at a contact portion with the pressing roller 92. The heating roller 91 includes a heater (e.g., a halogen lamp) therein, by which the heating roller 91 is heated to a predetermined heating temperature. The pressing roller 92 has a metal roller shaft coated with a roller made of elastic material (e.g., rubber), and is disposed below the heating roller 91 in a state pressed against the heating roller 91 inside the body casing 10. Also, the pressing roller 92 is rotatably supported and rotates with the heating roller 91.

Now, a printing operation as the image forming operation by the present laser printer is explained.

In the printing operation, the photosensitive drum 51 is rotationally driven. Along with the rotation, the surface of the photosensitive drum 51 is positively charged by the scorotron charger 52 in a uniform manner, and further exposed to a laser beam from the scanner unit 70 by rapid scanning. Then, an electrostatic latent image based on image data is formed.

Toner is supplied to the developing roller 62 by the rotation of the supply roller 63. At the time, the toner is positively charged by friction between the supply roller 63 and the developing roller 62. The toner on the developing roller 62 then enters between the pressing portion of the layer thickness control blade 64 and the developing roller 62, as the developing roller 62 rotates, where the toner is further frictionally charged and carried onto the developing roller 62 as a thin layer having a certain thickness.

The toner on the developing roller 62 is adhered to the electrostatic latent image formed on the surface of the photosensitive drum 51, that is, a part exposed to the laser beam and having a low potential, of the surface of the photosensitive drum 51 positively charged in a uniform manner. The toner is selectively carried so as to develop the electrostatic latent image into a visible image. In this manner, a toner image is formed on the surface of the photosensitive drum 51.

The front edge of the sheet conveyed from the feed tray 20 is aligned by the conveying rollers 30, and the sheet is sent to a transfer region (a contact region between the photosensitive drum 51 and the transfer roller 80) so as to be brought into contact with the surface of the photosensitive drum 51. At the time, the toner image on the photosensitive drum 51 is transferred onto the sheet by the transfer roller 80 to which the transfer bias is applied. The toner image transferred onto the sheet in this manner is heated when passed between the heating roller 91 and the pressing roller 92 in the fixing device 90, and fixed on the sheet. Then, an image is printed on the sheet. The sheet having the image printed thereon is discharged to a discharge tray 12 provided on top of the body casing 10.

An electrical structure of the present laser printer is explained hereafter.

Figure 3:
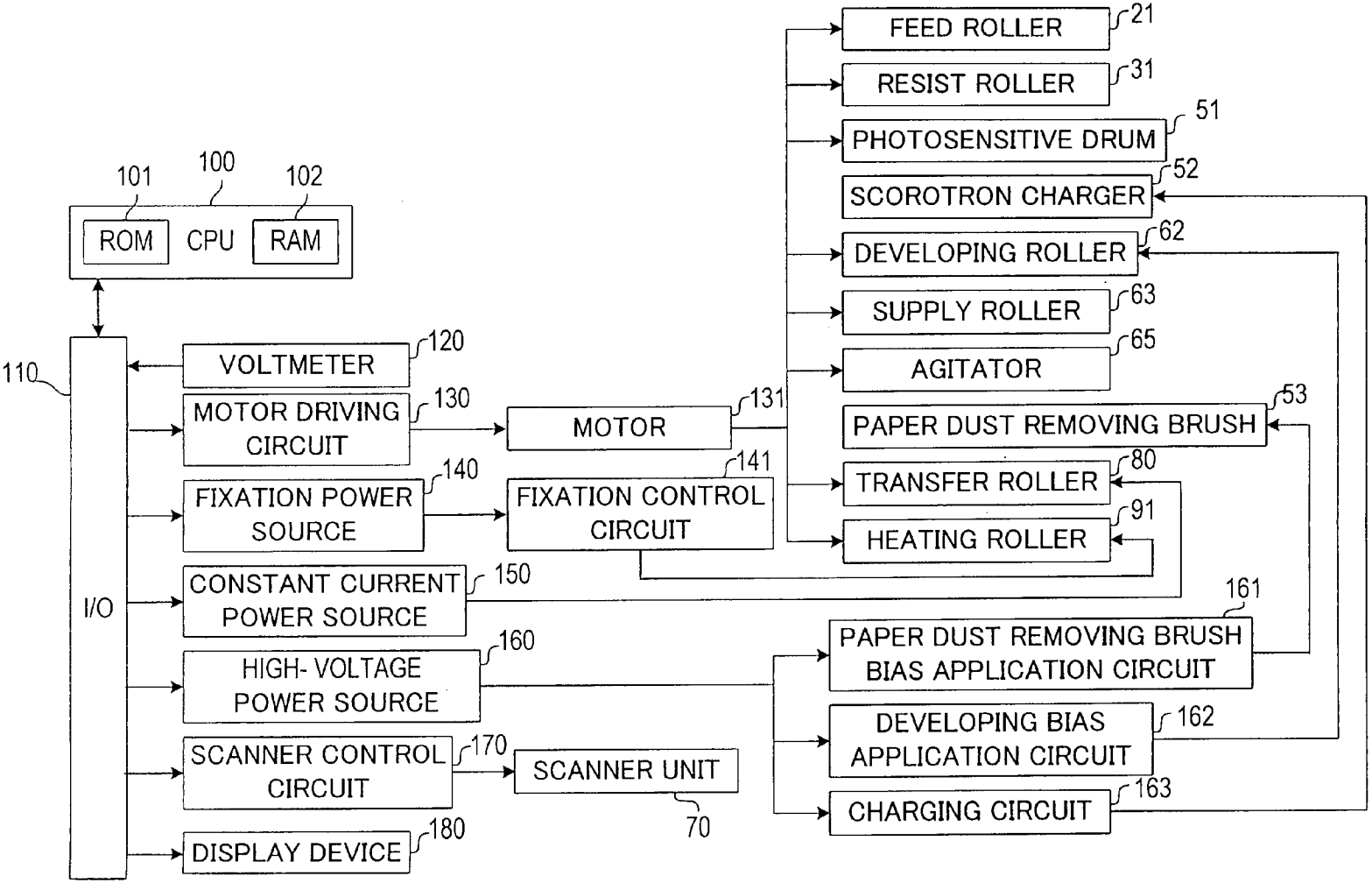
FIG. 3 is a block diagram illustrating an electrical structure of the laser printer according to the first embodiment.
Figure 4:
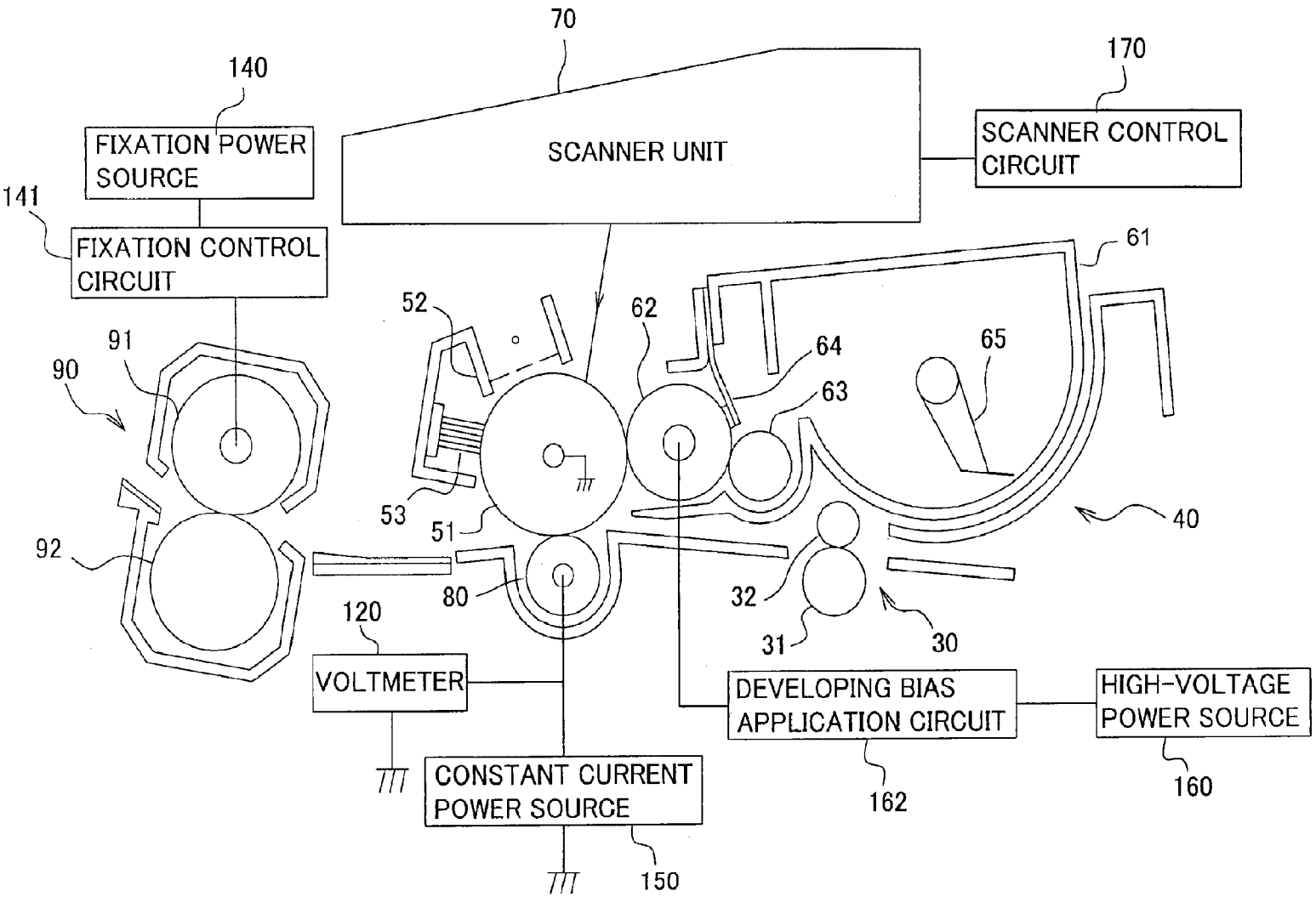
FIG. 4 is an explanatory view illustrating an electrical structure of main portions of the laser printer according to the first embodiment.

FIG. 3 is a block diagram illustrating an electrical structure of the present laser printer. FIG. 4 is an explanatory view illustrating an electrical structure of main portions of the present laser printer.

Referring to FIG. 3, to a CPU 100 which controls each portion of the present laser printer via a input/output interface (I/O) 110 are connected a voltmeter 120, a motor driving circuit 130, a fixation power source 140, a constant current power source 150, a high-voltage power source 160, a scanner control circuit 170, and a display device 180.

The CPU 100 comprises a ROM 101 and a RAM 102. The ROM 101 stores programs in order to implement the aforementioned printing operation. The RAM 102 stores temporary numeric values for drive control of the respective portions of the laser printer.

The voltmeter 120 is for detecting a transfer voltage applied to the transfer roller 80. One end of the wiring is connected to midstream of the wiring connecting the roller shaft of the transfer roller 80 and the constant current power source 150, and the other end is earthed (see FIG. 4).

The motor 131 is connected to the motor driving circuit 130. The feed roller 21, the resist roller 31, the photosensitive drum 51, the developing roller 62, the supply roller 63, the agitator 65, the transfer roller 80, and the heating roller 91 are connected to the motor 131 via a not shown gear train. In other words, these rollers are rotationally driven by a common motor 131. The drive and stop and rotation speed of the motor 131 are controlled by the programs stored in the ROM 101 of the CPU 100 through the motor driving circuit 130. Accordingly, the feed roller 21, the resist roller 31, the photosensitive drum 51, the developing roller 62, the supply roller 63, the agitator 65, the transfer roller 80, and the heating roller 91 are controlled based on the programs executed by the CPU 100.

The fixation power source 140 is connected to the heating roller 91 (particularly, to the heater equipped in the heating roller 91) via a fixation control circuit 141 (see FIG. 4). The temperature of the heating roller 91 is controlled by the program stored inside the CPU 100 through the fixation control circuit 141.

The constant current power source 150 is connected to the roller shaft of the transfer roller 80 (see FIG. 4). The constant current power source 150 performs constant current control in which the transfer voltage is applied so that the transfer current having a constant current value is passed to the transfer roller 80. The on and off of the application of the transfer voltage by the constant current power source 150 is controlled by the program stored in the ROM 101 of the CPU 100.

The paper dust removing brush 53, the roller shaft of the developing roller 62, and the scorotron charger 52 are connected to the high-voltage power source 160, respectively via a paper dust removing brush bias application circuit 161, via a developing bias application circuit 162 (see FIG. 4), and via a charging circuit 163. According to the programs stored in the ROM 101 of the CPU 100, the on and off of the application of the paper dust removing brush bias is controlled via the paper dust removing brush bias application circuit 161, the on and off of the application of the developing bias is controlled via the developing bias application circuit 162, and the on and off of the charging is controlled via the charging circuit 163.

The scanner unit 70 (particularly, the laser emitter of the scanner unit 70) is connected to the scanner control circuit 170 (see FIG. 4). The power of the laser beam irradiated from the scanner unit 70 via the scanner control circuit 170 is controlled according to the programs stored in the ROM 101 of the CPU 100.

The display device 180, not shown in FIG. 1, is provided on the upper face of the body casing 10. The display device 180 performs a notification operation to a user by displaying messages on a liquid crystal panel.

The present laser printer is designed to switch the operation mode of the printing operation when a resistance value of the transfer roller 80 exceeds a predetermined reference limiting value, from a first printing mode as a standard printing mode to a second printing mode in which defective transfer by the transfer roller 80 is better inhibited than the case in the first printing mode. Calculation of the resistance value of the transfer roller 80 is described in U.S. Patent Publication No. 2004-0057740-A1 published Mar. 25, 2004 which is incorporated herein by reference.

Particularly, the second printing mode is different from the first printing mode in the following respects (a1) to (a4).

Figure 5A:
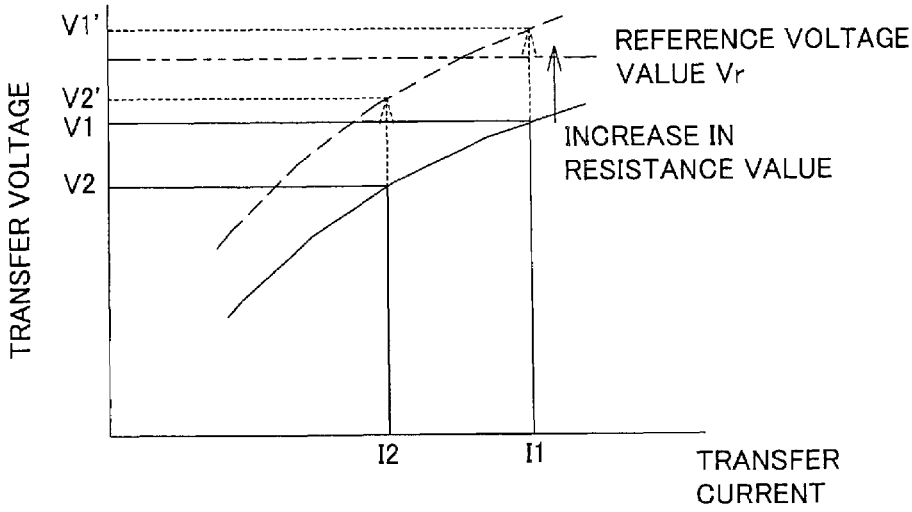
FIGS. 5A and 5B are explanatory views illustrating a second printing mode in the first embodiment.

(a1): The current value of the transfer current is set low. That is, as shown in FIG. 5A, as the resistance value of the transfer roller 80 is increased (from a curved solid line to a curved dotted line in FIG. 5A), a voltage value of the transfer voltage required for passing the transfer current having a current value I1 is increased (from V1 to V1'). However, as the voltage value of the transfer voltage is excessively raised, electric discharge tends to occur between the transfer roller 80 and the sheet. Accordingly, defective transfer due to the electric discharge may occur. Therefore, a current value 12 which is lower than the current value I1 in the first printing mode is set to the current value of the transfer current. Then, the voltage value of the transfer voltage is decreased (from V1' to V2') and the defective transfer due to electric discharge is inhibited.

Figure 5B:
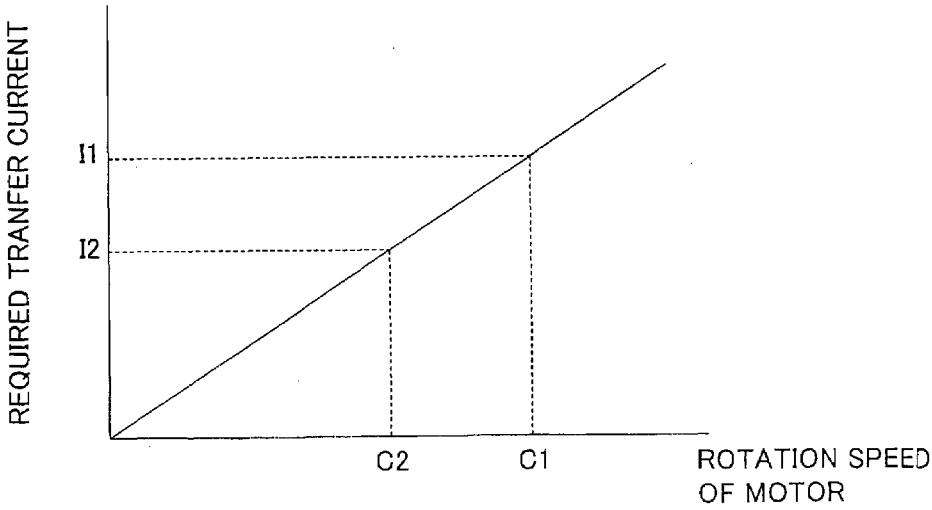

(a2): The conveying speed of the sheet (rotation speed of the motor 131 in the present embodiment) is set low. That is, as shown in FIG. 5B, the higher the conveying speed of the sheet (rotation speed of the motor 131) is (the shorter the transfer time is), the higher the current value of the transfer current is required for transferring a certain toner image. To the contrary, the lower the conveying speed (rotation speed of the motor 131) of the sheet is (the longer the transfer time is), the lower the current value of the transfer current is required for transferring the certain toner image. Accordingly, while the current value of the transfer current is decreased (from I1 to I2) as in the above (a1), the conveying speed (rotation speed of the motor 131) of the sheet is decreased (from C1 to C2) so that the transfer time becomes long. As a result, it is possible to inhibit defective transfer (such as appearance of ghost images in which the toner failed to be transferred and left on the photosensitive drum 51 is transferred onto the sheet in subsequent printing cycles) due to insufficient transfer of the toner image caused by the transfer current having a low current value.

(a3): The power of the laser beam (hereafter, referred to as the "laser power") irradiated from the scanner unit 70 is set low. That is, by setting the rotation speed of the motor 131 low as in the above (a2), an irradiation time of the laser beam to the photosensitive drum 51 becomes long. Therefore, while the rotation speed of the motor 131 is set low, the laser power is also set low so that the potential of the exposed part on the surface of the photosensitive drum 51 is not varied between the first printing mode and the second printing mode.

(a4): The heating temperature by the heating roller 91 is set low. That is, as the rotation speed of the motor 131 is set low as in the above (a2), a heating time of the sheet by the fixing device 90 becomes long. Therefore, while the rotation speed of the motor 131 is set low, the heating temperature by the heating roller 91 is also set low so that a heating amount given to the sheet is not varied between the first printing mode and the second printing mode.

Figure 6:
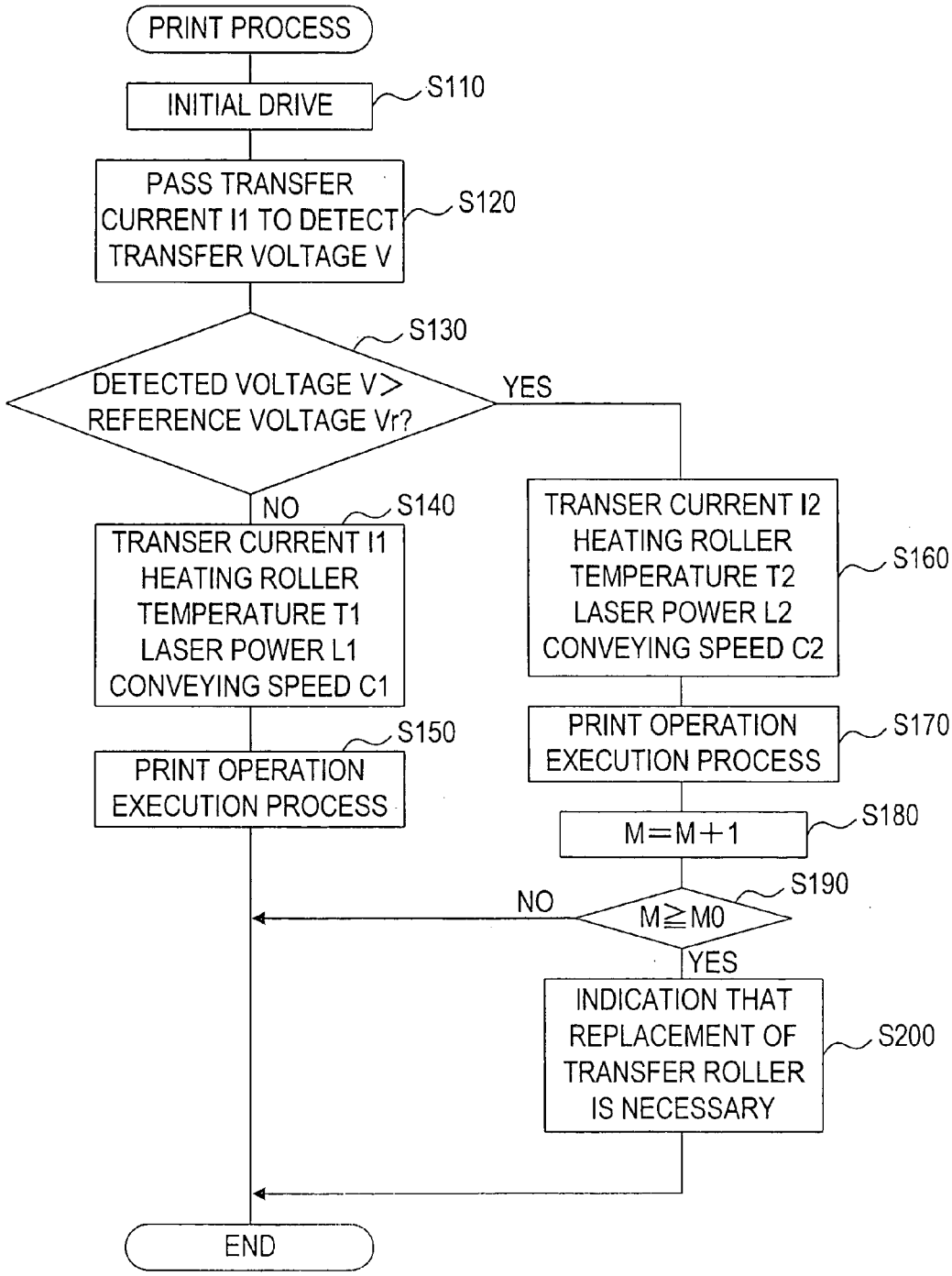
FIG. 6 is a flowchart of a print process in the first embodiment.

From now on, the print process performed by the CPU 100 of the present laser printer in receipt of print instructions transmitted from an external personal computer is explained by way of a flowchart in FIG. 6.

When the print process is started, the motor 131 is operated as an initial drive in S110 before a sheet is conveyed. The rotation speed of the motor 131 is the same as the rotation speed of the motor 131 (rotation speed of the motor 131 in the first printing mode) set in later-explained S140.

In S120, a transfer current having a current value I1 is passed to the transfer roller 80. The voltage value V of the transfer voltage at the time is detected.

In S130, it is determined whether the voltage value V of the transfer voltage detected in S120 exceeds a predetermined reference voltage value Vr. The reference voltage value Vr is set as high as possible within a range in which it is difficult for electrical discharge to occur. Therefore, the reference voltage value Vr is a criterion for determining whether the defective transfer due to electrical discharge tends to occur. That is, it is determined in S130 whether the resistance value of the transfer roller 80 exceeds a predetermined reference limiting value.

When it is determined in S130 that the detected voltage value V of the transfer voltage does not exceed the reference voltage value Vr (the voltage value V of the transfer voltage is less than the reference voltage value Vr), the process moves to S140. The operation mode of the print process is switched to the first printing mode. Particularly, I1 is set to the current value of the transfer current, T1 is set to the heating temperature of the heating roller 91, L1 is set to the laser power of the scanner unit 70, C1 is set to the conveying speed of the sheet (rotation speed of the motor 131). That is, when it is determined that the resistance value of the transfer roller 80 does not exceed the predetermined reference limiting value (when the transfer roller 80 is in a favorable state), the operation mode of the print process is set to the first printing mode.

In S150, a print operation execution process for executing a printing operation in which an image is printed on the sheet is performed based on the conditions set in S140. The print process is then ended.

On the other hand, when it is determined in S130 that the detected voltage value V of the transfer voltage exceeds the reference voltage value Vr, the process moves to S160. The operation mode of the print process is set to the second printing mode. Particularly, I2 (<I1) is set to the current value of the transfer current, T2 (<T1) is set to the heating temperature of the heating roller 91, L2 (<L1) is set to the laser power of the scanner unit 70, C2 (<C1) is set to the conveying speed of the sheet (rotation speed of the motor 131). That is, when it is determined that the resistance value of the transfer roller 80 exceeds the predetermined reference limiting value (when the transfer roller 80 is deteriorated), the operation mode of the print process is set to the second printing mode.

In S170, a print operation execution process for executing a printing operation in which an image is printed on the sheet is performed based on the conditions set in S160.

In S180, a value of a variable M is incremented (1 is added). The variable M is set 0 when the transfer roller 80 is brand-new. Each time the transfer roller 80 is replaced, 0 is set to the variable M. In other words, the variable M is for counting the number of times it is determined that the resistance value of the currently used transfer roller 80 exceeds the predetermined reference limiting value.

In S190, it is determined whether the value in the variable M is equal to or more than a predetermined reference value M0. That is, based on whether the resistance value of the transfer roller 80 exceeds the reference limiting value, it is determined whether the replacement of the transfer roller 80 is necessary.

In S190, when it is determined that the value in the variable M is not equal to or more than M0 (less than M0) (when it is determined that the replacement of the transfer roller 80 is not necessary), the print process is then ended.

On the other hand, when it is determined in S190 that the value in the variable M is equal to or more than M0 (when it is determined that the replacement of the transfer roller 80 is necessary), the process moves to S200. In S200, a message indicating that the replacement of the transfer roller 80 is necessary is displayed on the display device 180. The print process is then ended.

As explained above, in the laser printer of the present embodiment, before starting the operation of printing an image on a sheet, a transfer current is passed to the transfer roller 80 under the conditions for the first printing mode, so as to detect the voltage value V of the transfer voltage at the time (S110, S120). When it is determined that the detected voltage value V does not exceed the reference voltage value Vr (the resistance value of the transfer roller 80 does not exceed the reference limiting value) (S130: NO), the operation mode of the print process is set to the first printing mode and the printing operation is performed (S140, S150). That is, if the resistance value of the transfer roller 80 does not exceed the reference limiting value, the standard printing operation is performed. On the other hand, when it is determined that the detected voltage value V exceeds the reference voltage value Vr (the resistance value of the transfer roller 80 exceeds the reference limiting value) (S130: YES), the operation mode of the print process is set to the second printing mode and the printing operation is performed (S160, S170). That is, if the resistance value of the transfer roller 80 exceeds the reference limiting value, the printing operation is performed under such conditions that inhibit defective transfer which may be caused by the high resistance value of the transfer roller 80. Therefore, according to the present laser printer, even if the resistance value of the transfer roller 80 is increased to an extent that defective transfer may readily occur due to the long-term use, the print process can be performed without defective transfer. Accordingly, the present laser printer can extend a usable period (a period during which the transfer roller 80 can be used for the printing operation) of the transfer roller 80 as compared with a conventional laser printer.

In the second printing mode of the present laser printer, defective transfer due to electrical discharge is inhibited by lowering the transfer current. Furthermore, in order to avoid defective transfer caused by lowering the transfer current (such as defective transfer due to insufficient transfer of the toner image onto a sheet), the rotation speed of the motor 131 is decreased so as to reduce the conveying speed of the paper and lengthen the transfer time. Therefore, according to the present laser printer, the defective transfer can be avoided without deteriorating quality of the printed image. Also by lowering the heating temperature by the heating roller 91, occurrence of defective fixation due to the change of the conveying speed of the sheet can be inhibited.

Specifically, the ionic conductive transfer roller 80 is used in the present laser printer. Such configuration is highly effective in switching the operation mode of the printing operation. This is because, while transfer can be favorably performed since the resistance value in the ionic conductive transfer roller 80 is uniform and less varied, the resistance value is readily increased along with its use.

In addition, in the present laser printer, when the number of times it is determined that the detected value V of the transfer voltage detected during the initial drive exceeds the reference voltage value Vr reaches M0 (S190: YES), a message indicating that the replacement of the transfer roller 80 is necessary is displayed on the display device 180 (S200). Therefore, according to the present laser printer, the user is urged to replace the transfer roller 80. Specifically, even if it is determined that the detected value V of the transfer voltage exceeds the reference voltage value Vr, the message is not displayed immediately. Accordingly, the user is not urged to replace the transfer roller 80 if only the detected value V of the transfer voltage temporarily exceeds the reference voltage value Vr due to changes in the environment such as temperature and humidity.

[First Variation of the First Embodiment]

In the laser printer of the aforementioned first embodiment, in order to inhibit defective transfer due to the high voltage value of the transfer voltage in the second printing mode, the constant current control is performed using the current value I2 which is lower than the current value I1 of the transfer current in the first printing mode. However, this is not the only way. For example, the constant voltage control may be performed in the second printing mode.

That is, the second printing mode in the first variation is different from the first printing mode in the following respects (b1) to (b4).

Figure 7A:
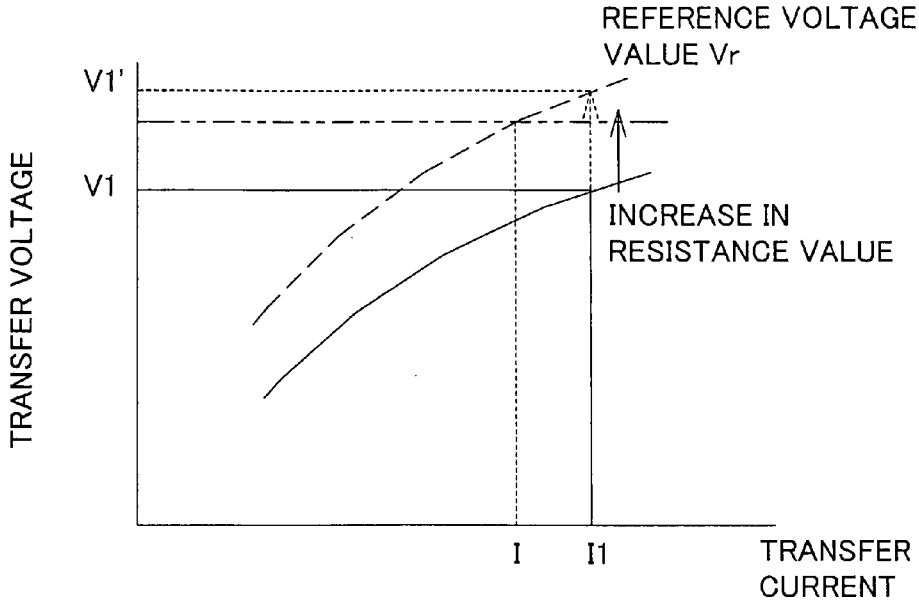
FIGS. 7A and 7B are explanatory views illustrating the second printing mode in a first variation of the first embodiment.

(b1): The constant voltage control is performed in which the transfer voltage having the reference voltage value Vr is applied to the transfer roller 80. That is, as shown in FIG. 7A, as the resistance value of the transfer roller 80 is increased (from a curved solid line to a curved dotted line in FIG. 7A), a voltage value of the transfer voltage required for passing the transfer current having a current value I1 is increased (from V1 to V1'). However, as the voltage value of the transfer voltage is excessively raised, electric discharge tends to occur between the transfer roller 80 and the sheet. Accordingly, defective transfer due to electric discharge may occur. Therefore, the reference voltage value Vr (the reference voltage value Vr in the aforementioned first embodiment) is set to the upper limit of the voltage value of the transfer voltage. Then, the voltage value of the transfer voltage is prevented from exceeding the reference voltage value Vr, and defective transfer due to electric discharge is inhibited.

Figure 7B:
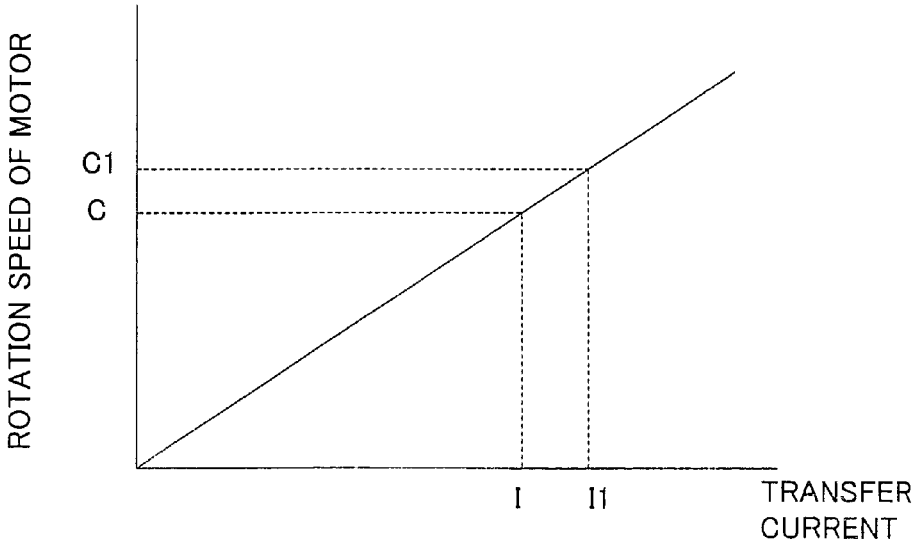

(b2): The conveying speed of the sheet (rotation speed of the motor 131 in the present embodiment) is set low. That is, when the resistance value of the transfer roller 80 is raised by setting the upper limit of the voltage value of the transfer voltage to the reference voltage value Vr as in the above (b1), the current value of the transfer current is decreased (from I1 to I). On the other hand, as shown in FIG. 7B, the higher the current value of the transfer current is, the higher the conveying speed (rotation speed of the motor 131 in the present embodiment) of the sheet can be when transferring a certain toner image (the transfer time can be shortened). To the contrary, the lower the current value of the transfer current is, the lower the conveying speed (rotation speed of the motor 131 in the present embodiment) of the sheet has to be when transferring the certain toner image (the transfer time has to be lengthened). Accordingly, while the current value of the transfer current decreased (from I1 to I), the conveying speed (rotation speed of the motor 131) of the sheet is decreased (from Cl to C) so that the transfer time is lengthened. As a result, it is possible to inhibit defective transfer due to insufficient transfer of the toner image caused by the low current value of the transfer current.

(b3): For the same reason as mentioned in the first embodiment, the laser power from the scanner unit 70 is set low.

(b4): For the same reason as mentioned in the first embodiment, the heating temperature by the heating roller 91 is set low.

Figure 8:
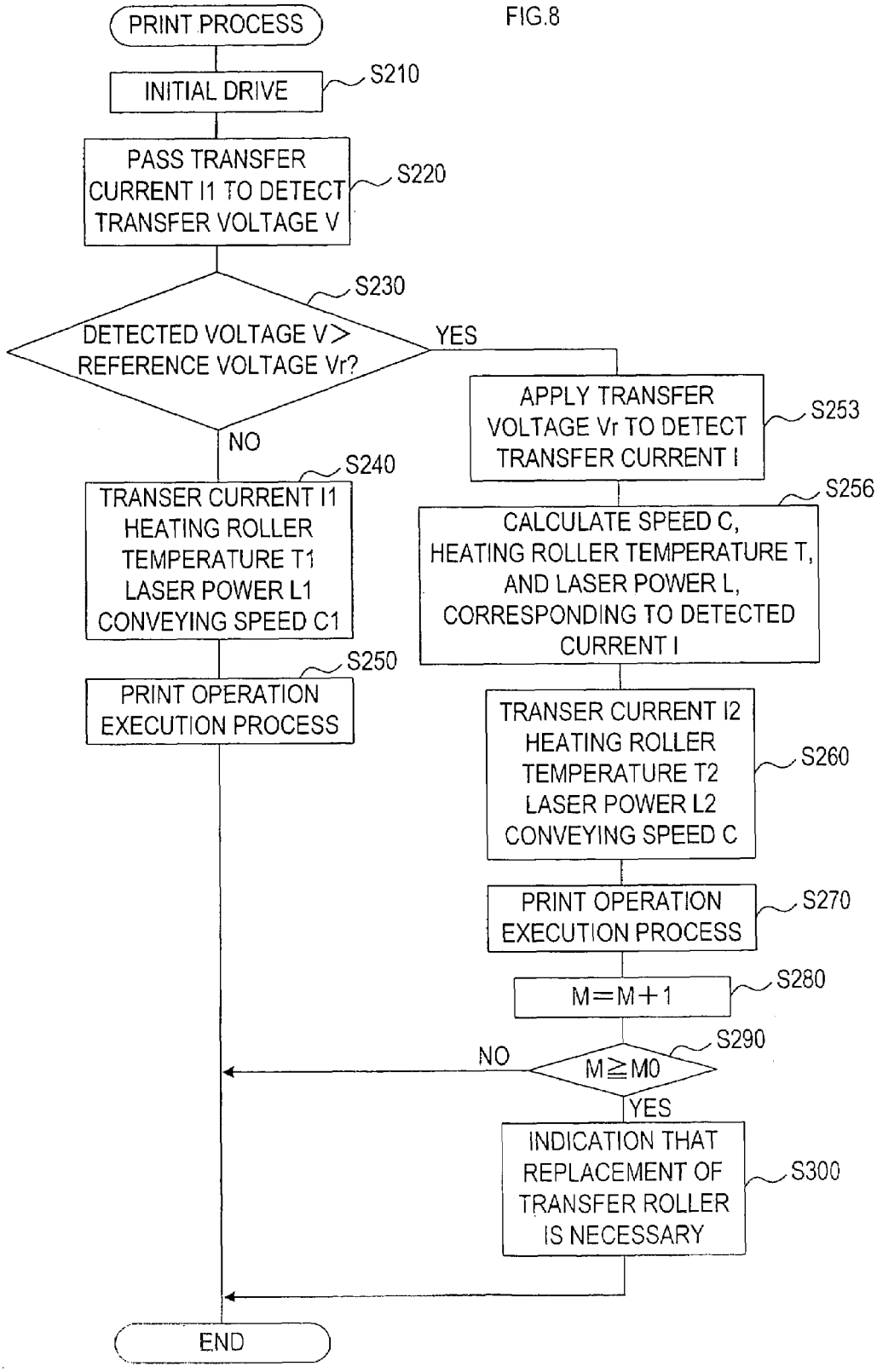
FIG. 8 is a flowchart of the print process in the first variation of the first embodiment.

From now on, a print process according to the first variation is explained by way of a flowchart in FIG. 8. Steps of S210 to S250 and S270 to S300 in this print process are the same with the steps of S110 to S150 and S170 to S200 in the print process according to the aforementioned first embodiment (FIG. 6). Therefore, the descriptions for those steps are not repeated.

In S230, when it is determined that the voltage value V of the detected transfer voltage exceeds the predetermined reference voltage value Vr, the process moves to S253. The transfer voltage of the reference voltage value Vr is applied to the transfer roller 80, and a current value I of the transfer current at the time is detected. The detected current value I is a value lower than the current value I1 of the transfer current in the first printing mode (see FIG. 7A).

In S256, a conveying speed (rotation speed of the motor 131) C corresponding to the current value I detected in S253 is calculated. The conveying speed C calculated herein is a value lower than the conveying speed C1 in the first printing mode (see FIG. 7B). Then, a heating temperature T of the heating roller 91 and a laser power L of the scanner unit 70, which correspond to the calculated conveying speed C, are calculated.

In S260, the operation mode of the printing operation is set to the second printing mode. Particularly, Vr is set to the voltage value of the transfer voltage of the constant voltage control, the value T (<T1) calculated in the above S256 is set to the heating temperature of the heating roller 91, the value L (<L1) calculated in the above S256 is set to the laser power of the scanner unit 70, the value C (<C1) calculated in the above S256 is set to the conveying speed (rotation speed of the motor 131) of the sheet.

According to the configuration of the first variation, the printing operation can be performed without the voltage value of the transfer voltage exceeding the reference voltage value Vr. Therefore, defective transfer due to electrical discharge can be reliably avoided. Specifically, in this configuration, the voltage value of the transfer voltage is not lowered beyond necessity. Accordingly, the current value of the transfer current can be raised within a range in which defective transfer can be inhibited.

[Second Variation of the First Embodiment]

In the laser printer of the aforementioned first embodiment, in order to inhibit defective transfer due to the low current value of the transfer current in the second printing mode, the sheet is conveyed at the conveying speed C2 which is lower than the sheet conveying speed C1 in the first printing mode. However, this is not the only way. For example, the developing potential (voltage value of the developing bias) applied to the developing roller 62 may be lowered.

That is, the second printing mode in the second variation is different from the first printing mode in the following respects (c1) to (c3).

(c1): For the same reason as mentioned in the first embodiment, the current value of the transfer current is set low.

Figure 9A:
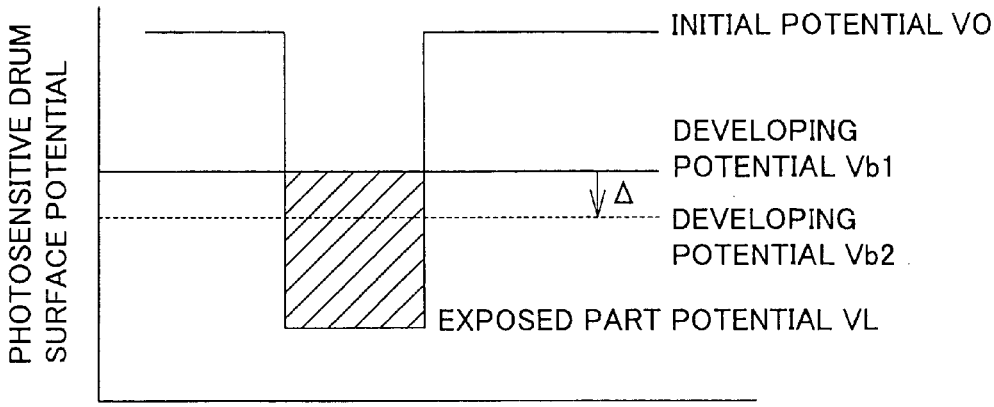
FIGS. 9A and 9B are explanatory views illustrating the second printing mode in a second variation of the first embodiment.
Figure 9B:
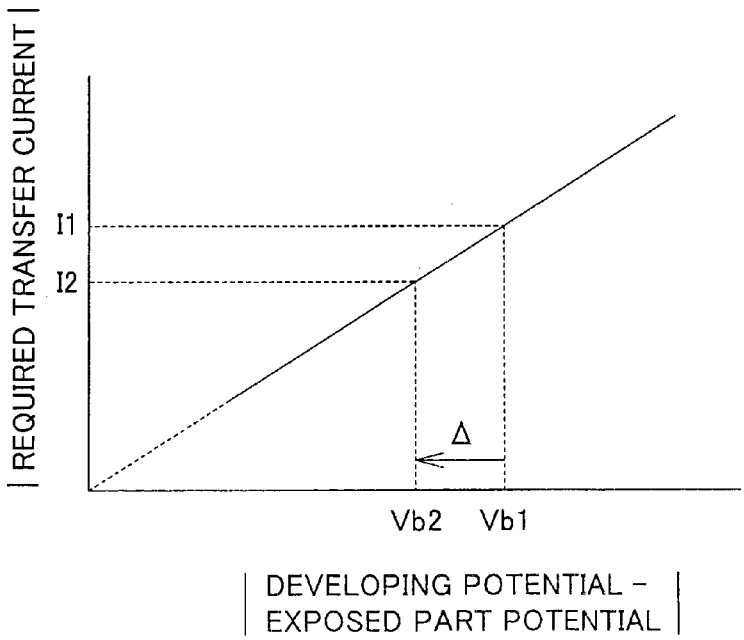

(c2): The developing potential is set low. That is, as shown in FIG. 9A, the part exposed by the scorotron charger 52 on the surface of the photosensitive drum 51 has an initial potential (charging potential) V0. Among the part exposed by the scorotron charger 52, the part exposed to the laser beam from the scanner unit 70 has an exposed part potential VL. The adhesion amount of toner corresponds to an absolute value of potential difference between a developing potential Vb and the exposed part potential VL. That is, for example, if the developing potential is Vb1, the area of the shaded part in FIG. 9A corresponds to the adhesion amount of toner. Therefore, the smaller the absolute value of the potential difference between the developing potential Vb and the exposed part potential VL, the smaller the amount of toner is which forms a certain toner image. As a result, the current value of the required transfer current can be low (see FIG. 9B). Accordingly, while the current value of the transfer current is decreased (from I1 to I2) as in the above (c1), the developing potential Vb is lowered so that the absolute value of the potential difference between the developing potential Vb and the exposed part potential VL is reduced and the amount of toner which forms a toner image is reduced. As a result, it is possible to inhibit defective transfer due to insufficient transfer of the toner image caused by the low current value of the transfer current.

(c3): The heating temperature by the heating roller 91 is set low. That is, as in the above (c2), while the amount of toner which forms a toner image is reduced, the heating temperature by the heating roller 91 is lowered so that the heating amount given to the toner is not varied between the first printing mode and the second printing mode.

Figure 10:
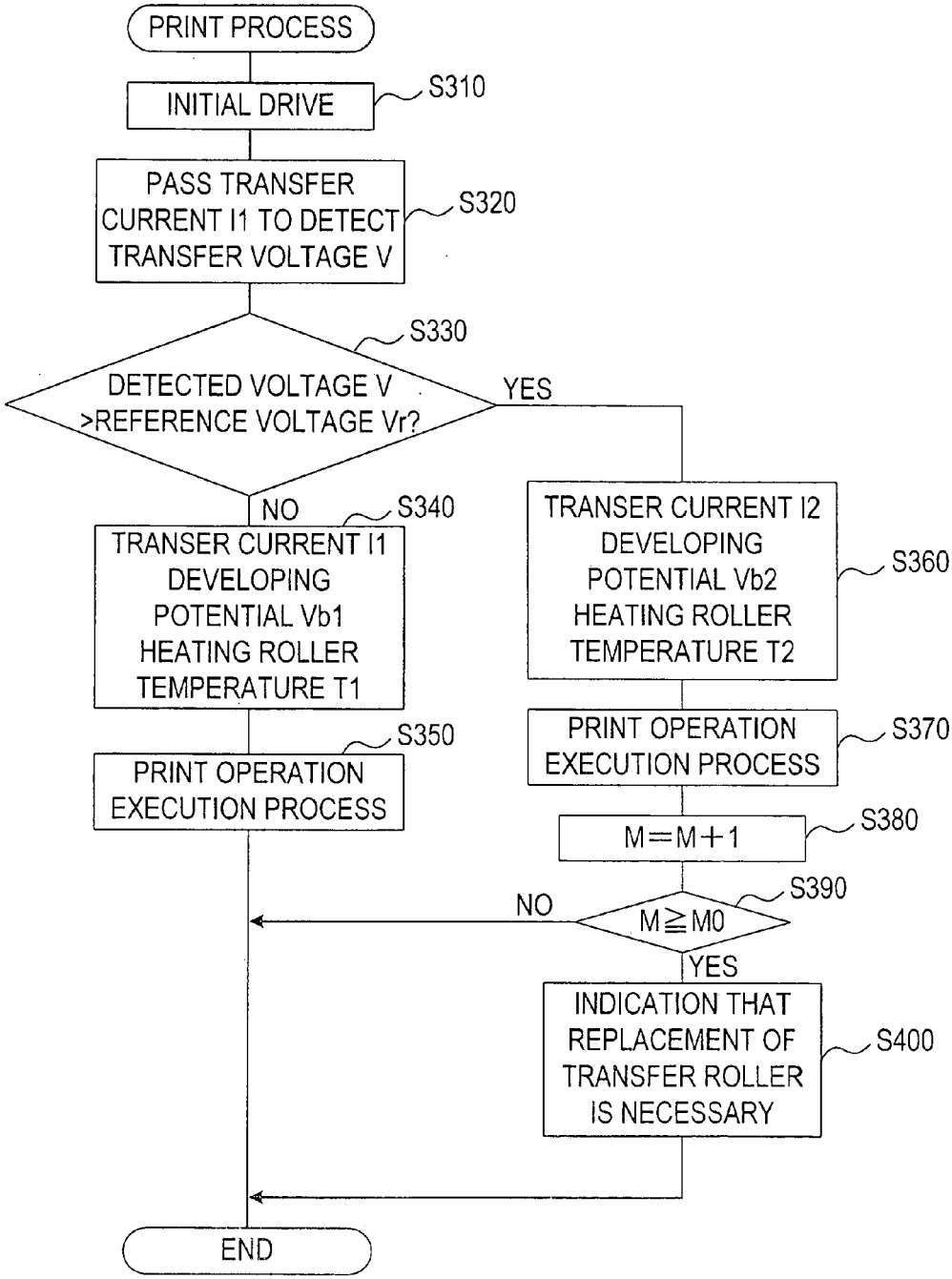
FIG. 10 is a flowchart of the print process in the second variation of the first embodiment.

Hereinafter, a print process according to the second variation is explained by way of a flowchart in FIG. 10. Steps of S310 to S330, S350, and S370 to S400 in this print process are the same with the steps of S110 to S130, S150, and S170 to S200 in the print process according to the aforementioned first embodiment (FIG. 6). Therefore, the descriptions for those steps are not repeated.

In S330, when it is determined that the voltage value V of the detected transfer voltage does not exceed the predetermined reference voltage value Vr (the voltage value V of the transfer voltage is equal to or lower than the reference voltage value Vr), the process moves to S340. The operation mode of the printing operation is set to the first printing mode. Particularly, I1 is set to the current value of the transfer current, Vb1 is set to the developing potential, and T1 is set to the heating temperature of the heating roller 91.

On the other hand, when it is determined in S330 that the voltage value V of the detected transfer voltage exceeds the predetermined reference voltage value Vr, the process moves to S360. The operation mode of the printing operation is set to the second printing mode. Particularly, I2 (<I1) is set to the current value of the transfer current, Vb2 (<Vb1) is set to the developing potential, and T2 (<T1) is set to the heating temperature of the heating roller 91.

According to the configuration of the second variation, defective transfer can be inhibited by reducing the density of an image to be printed, without lowering the speed of the printing operation.

[Third Variation of the First Embodiment]

In the laser printer of the aforementioned first embodiment, in order to inhibit defective transfer due to the low current value of the transfer current in the second printing mode, the sheet is conveyed at the conveying speed C2 which is lower than the sheet conveying speed C1 in the first printing mode. However, this is not the only way. For example, the exposing degree by the scanner unit 70 may be set low (particularly, the laser power may be set low). The exposing degree is determined depending on the irradiation time of the laser beam per unit area, the light intensity of the laser beam, and so on.

That is, the second printing mode in the third variation is different from the first printing mode in the following respects (d1) to (d3).

(d1): For the same reason as mentioned in the first embodiment, the current value of the transfer current is set low.

Figure 11A:
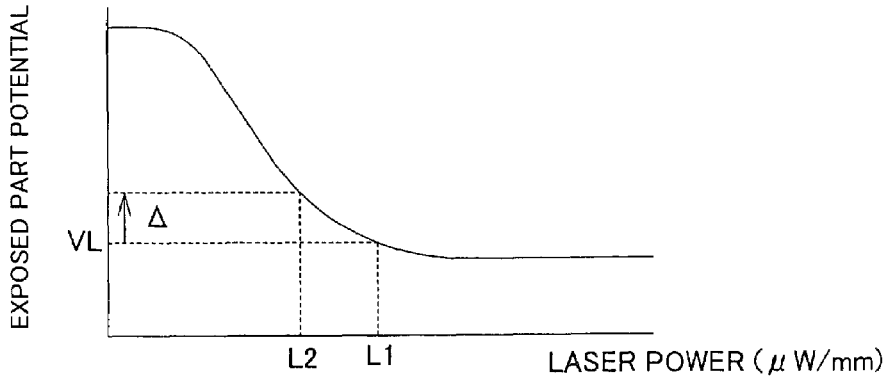
FIGS. 11A-11C are explanatory views illustrating the second printing mode in a third variation of the first embodiment.
Figure 11B:
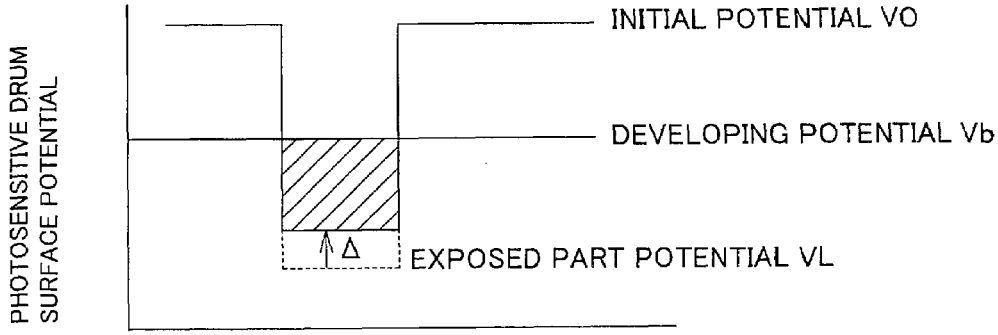
Figure 11C:
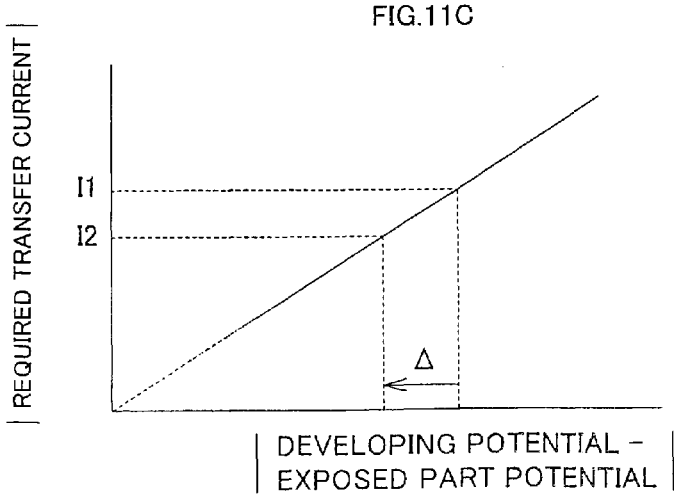

(d2): The laser power is set low. That is, as shown in FIG. 11A, the exposed part potential VL on the surface of the photosensitive drum 51 is lowered as the laser power is increased. Therefore, by reducing the laser power, the exposed part potential VL can be raised. The adhesion amount of toner corresponds to the absolute value of the potential difference between the developing potential Vb and the exposed part potential VL. That is, the area of the shaded part in FIG. 11B corresponds to the adhesion amount of toner. Therefore, the smaller the absolute value of the potential difference is between the developing potential Vb and the exposed part potential VL, the smaller the amount of toner is which forms a certain toner image. As a result, the current value of the required transfer current can be low (see FIG. 11C). Accordingly, while the current value of the transfer current is decreased (from I1 to I2) as in the above (d1), the developing potential Vb is raised so that the absolute value of the potential difference between the developing potential Vb and the exposed part potential VL is reduced and the amount of toner which forms a toner image is reduced. As a result, it is possible to inhibit defective transfer due to insufficient transfer of the toner image caused by the low current value of the transfer current.

(d3): The heating temperature by the heating roller 91 is set low. That is, as in the above (d2), while the amount of toner which forms a toner image is reduced, the heating temperature by the heating roller 91 is lowered so that the heating amount given to the toner is not varied between the first printing mode and the second printing mode.

Figure 12:
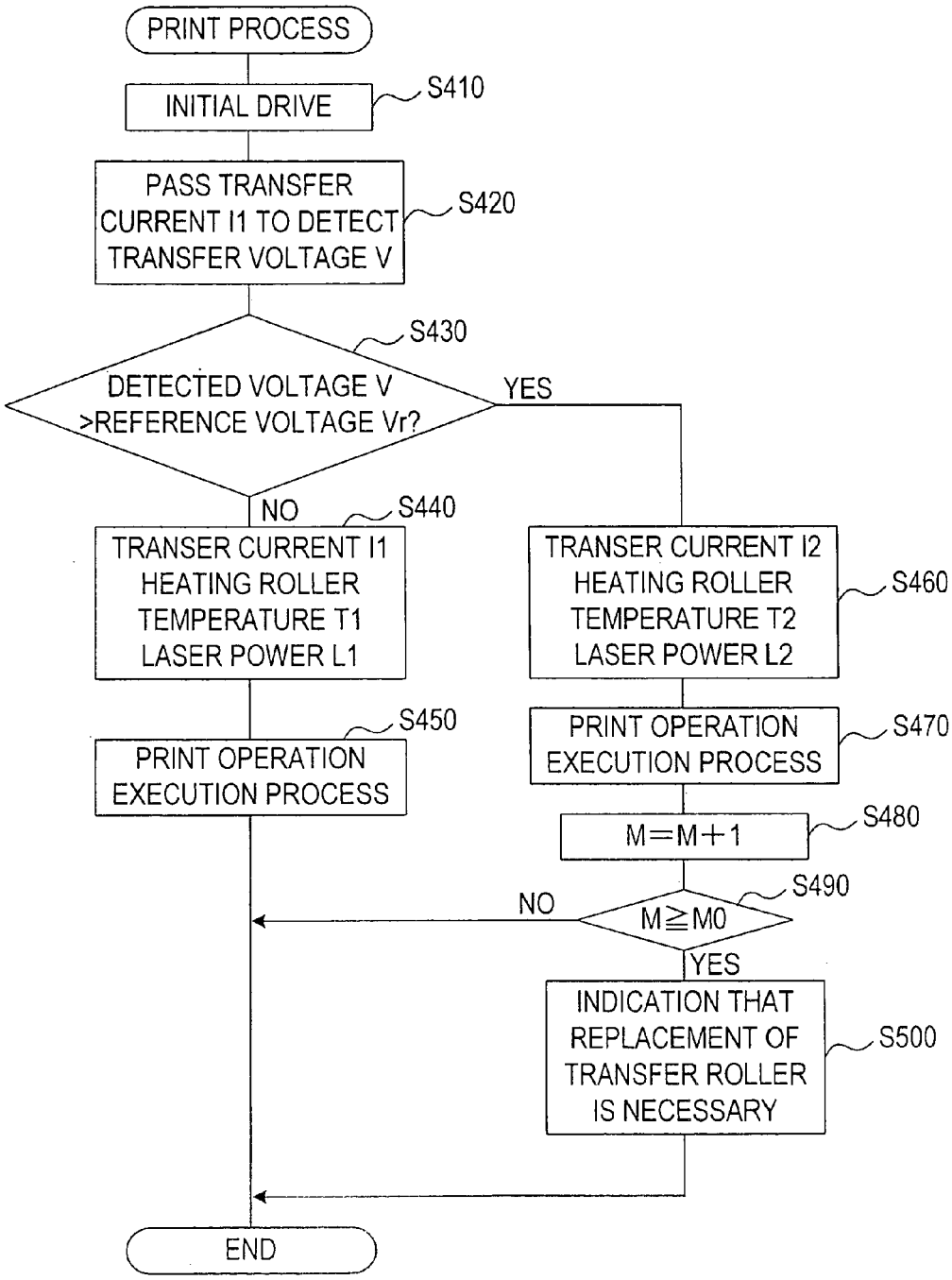
FIG. 12 is a flowchart of the print process in the third variation of the first embodiment.

Hereinafter, a print process according to the third variation is explained by way of a flowchart in FIG. 12. Steps of S410 to S430, S450, and S470 to S500 in this print process are the same as the steps of S110 to S130, S150, and S170 to S200 in the print process according to the aforementioned first embodiment (FIG. 6). Therefore, the descriptions for those steps are not repeated.

In S430, when it is determined that the voltage value V of the detected transfer voltage does not exceed the predetermined reference voltage value Vr (the voltage value V of the transfer voltage is equal to or lower than the reference voltage value Vr), the process moves to S440. The operation mode of the printing operation is set to the first printing mode. Particularly, I1 is set to the current value of the transfer current, T1 is set to the heating temperature of the heating roller 91, and L1 is set to the laser power.

On the other hand, when it is determined in S430 that the voltage value V of the detected transfer voltage exceeds the predetermined reference voltage value Vr, the process moves to S460. The operation mode of the printing operation is set to the second printing mode. Particularly, I2 (<I1) is set to the current value of the transfer current, T2 (<T1) is set to the heating temperature of the heating roller 91, and L2 (<L1) is set to the laser power.

According to the configuration of the third variation, defective transfer can be inhibited without lowering the speed of the printing operation.

Now, a laser printer according to a second embodiment is explained.

The laser printer according to the second embodiment is basically the same with the laser printer according to the first embodiment. Accordingly, the same reference numbers are given to the common components, and the detailed descriptions thereof are omitted.

Figure 13:
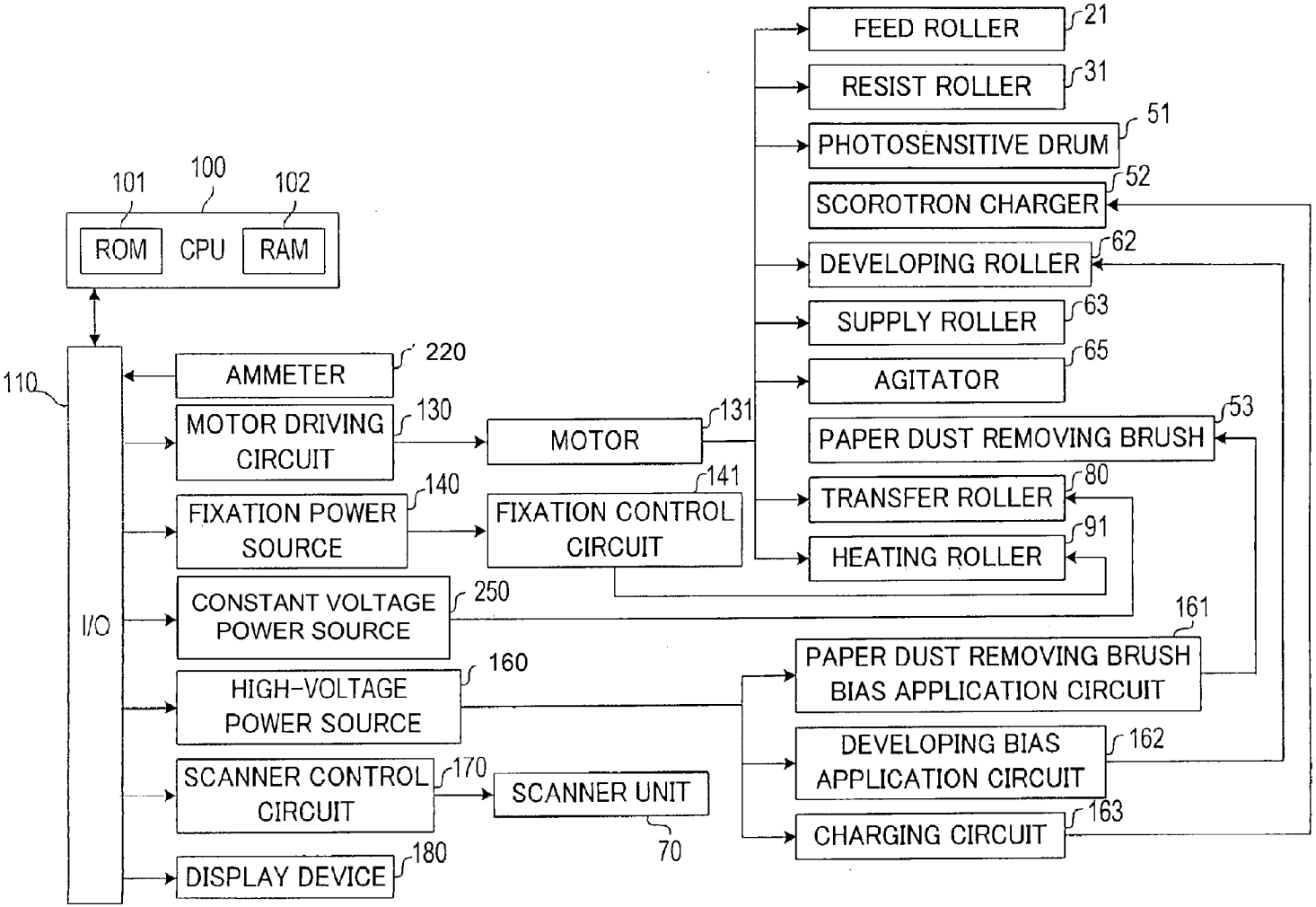
FIG. 13 is a block diagram illustrating an electrical structure of a laser printer according to a second embodiment.
Figure 14:
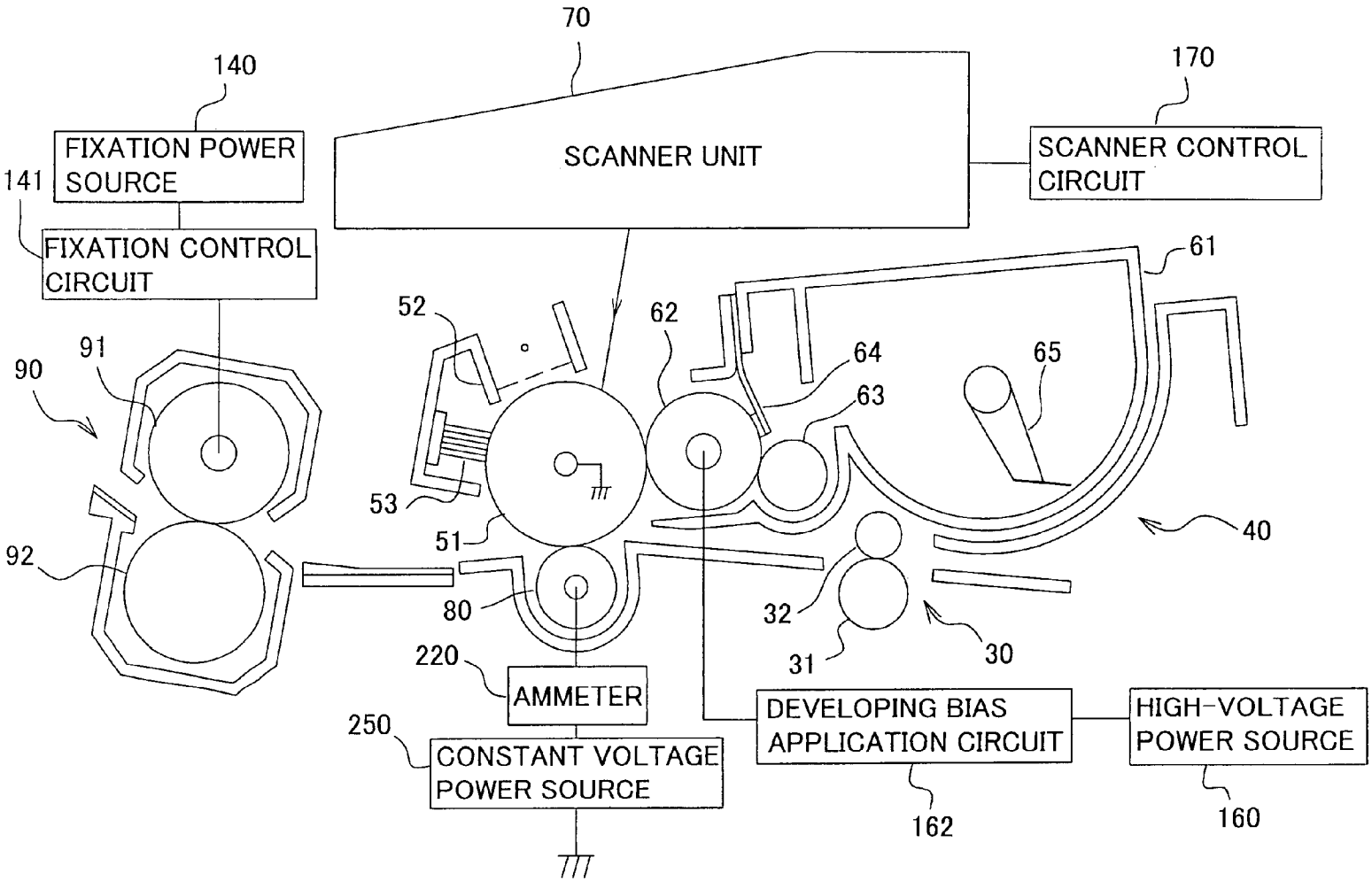
FIG. 14 is an explanatory view illustrating an electrical structure of main portions of the laser printer according to the second embodiment.

FIG. 13 is a block diagram illustrating an electrical structure of the laser printer according to the present embodiment. FIG. 14 is an explanatory view illustrating an electrical structure of main portions of the laser printer.

As shown in FIG. 13, the laser printer of the second embodiment is different from the laser printer of the first embodiment (FIG. 3) in that an ammeter 220 is provided instead of the voltmeter 120, and a constant voltage power source 250 is provided instead of the constant current power source 150.

The ammeter 220 is for detecting the transfer current passed to the transfer roller 80. The ammeter 220 is provided in midstream of the wiring connecting the roller shaft of the transfer roller 80 and the constant voltage power source 250 (see FIG. 14).

The constant voltage power source 250 is connected to the roller shaft of the transfer roller 80 via the ammeter 220 (see FIG. 14). The constant voltage power source 250 performs constant voltage control in which the transfer voltage having a constant current value is applied to the transfer roller 80. The on and off of the application of the transfer voltage by the constant voltage power source 250 is controlled by the program stored in the ROM 101 of the CPU 100.

The laser printer of the second embodiment, as well as the laser printer of the first embodiment, is designed to switch the operation mode of the printing operation when the resistance value of the transfer roller 80 exceeds the predetermined reference limiting value, from a first printing mode as a standard printing mode to a second printing mode in which defective transfer by the transfer roller 80 is better inhibited than the case in the first printing mode.

In the laser printer of the second embodiment, the second printing mode is different from the first printing mode in the following respects (e1) to (e4).

Figure 15A:
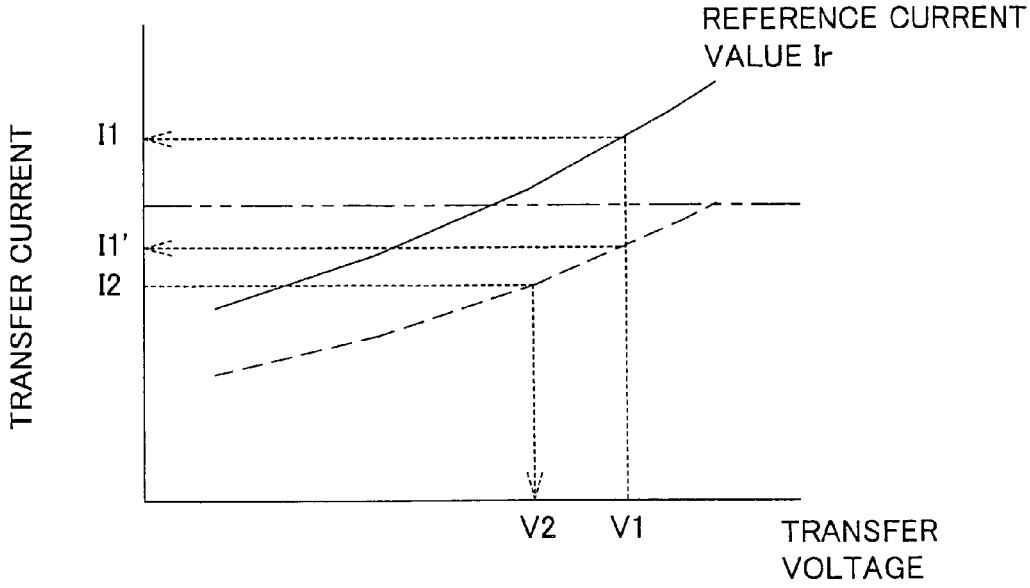
FIGS. 15A and 15B are explanatory views illustrating the second printing mode in the second embodiment.
Figure 15B:
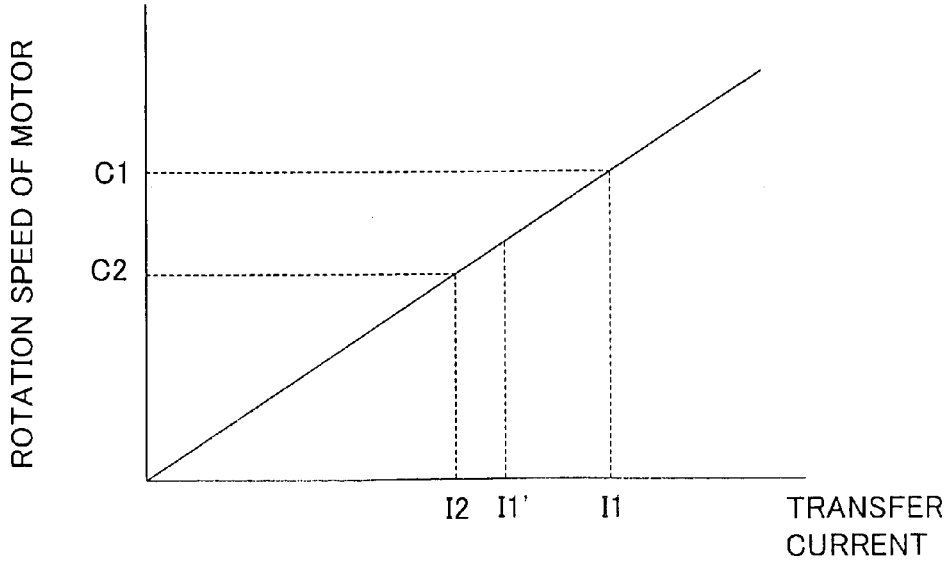

(e1): The conveying speed of the sheet (rotation speed of the motor 131) is set low. That is, as shown in FIG. 15A, as the resistance value of the transfer roller 80 is increased (from a curved solid line to a curved dotted line in FIG. 15A), the current value of the transfer current passed when the transfer voltage having a certain voltage value V1 is applied is decreased (from I1 to I1'). As the current value of the transfer current is excessively lowered, transfer of the toner image from the surface of the photosensitive drum 51 onto the sheet is not sufficiently performed, and thus, defective transfer may occur. As shown in FIG. 15B, the higher the current value of the transfer current, the higher the conveying speed of the sheet (rotation speed of the motor 131) in transferring a certain toner image can be (the transfer time can be short). To the contrary, the lower the current value of the transfer current, the lower the conveying speed of the sheet is required in transferring a certain toner image (the transfer time is required to be long). Accordingly, while the conveying speed of the sheet (rotation speed of the motor 131) is decreased (from C1 to C2) so that the transfer time becomes long, it is possible to inhibit defective transfer due to insufficient transfer of the toner image even if the current value of the transfer current is low.

(e2): For the same reason as mentioned in the first embodiment, the laser power from the scanner unit 70 is set low.

(e3): For the same reason as mentioned in the first embodiment, the heating temperature by the heating roller 91 is set low.

(e4): The voltage value of the transfer voltage is set low. That is, as described above, in the case of the constant voltage control, the current value of the transfer current is lowered by the rise in the resistance value of the transfer roller 80. Accordingly, a condition is set which inhibits defective transfer even if the current value is within a range in which electric discharge can be inhibited (in the present embodiment, the conveying speed is lowered as in the above (e1)). Consequently, the voltage value of the transfer voltage is decreased (from V1 to V2) so that the condition sufficiently allows for fluctuation in the voltage value of the transfer voltage.

Figure 16:
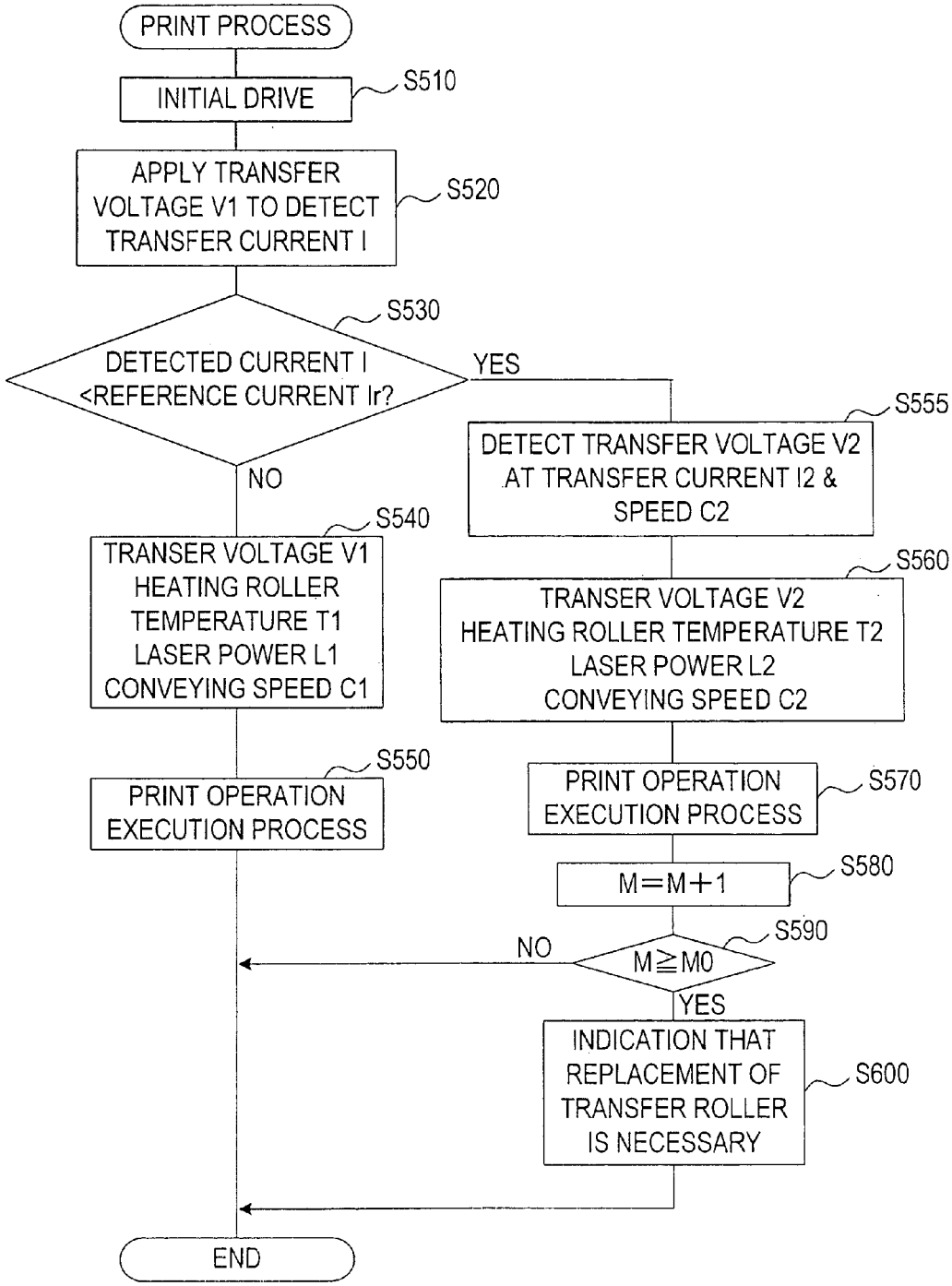
FIG. 16 is a flowchart of a print process in the second embodiment.

From now on, a print process executed by the CPU 100 of the laser printer according to the second embodiment is explained by way of a flowchart in FIG. 16. Steps of S510, S550, and S570 to S600 in this print process are the same as the steps of S110, S150, and S170 to S200 in the print process according to the aforementioned first embodiment (FIG. 6). Therefore, the descriptions for those steps are not repeated.

In S520, the transfer voltage having the voltage value V1 is applied to the transfer roller 80. The current value I of the transfer current at the time is detected.

In S530, it is determined whether the current value I of the transfer current detected in S520 falls below a predetermined reference current value Ir. The reference current value Ir is set as low as possible within a range in which it is difficult for defective transfer to occur. Therefore, the reference current value Ir is a criterion for determining whether defective transfer tends to occur. That is, it is determined in S530 whether the resistance value of the transfer roller 80 exceeds a predetermined reference limiting value.

When it is determined in S530 that the detected current value I of the transfer current does not fall below the reference current value Ir (the current value I of the transfer current is equal to or more than the reference current value Ir), the process moves to S540. The operation mode of the print process is set to the first printing mode. Particularly, V1 is set to the voltage value of the transfer voltage, T1 is set to the heating temperature of the heating roller 91, L1 is set to the laser power of the scanner unit 70, C1 is set to the conveying speed of the sheet (rotation speed of the motor 131). That is, when it is determined that the resistance value of the transfer roller 80 does not exceed the predetermined reference limiting value (when the transfer roller 80 is in a favorable state), the operation mode of the print process is set to the first printing mode.

On the other hand, when it is determined in S530 that the detected current value I of the transfer current falls below the reference current value Ir, the process moves to S555. C2 is set to the rotation speed of the motor 131 and the transfer current having a current value I2 is passed. A transfer voltage V2 at the time is detected. The current value I2 is a predetermined value, which is lower than the current value of the transfer current passed in the printing operation of the first printing mode. Accordingly, the transfer voltage V2 is a value lower than the transfer voltage V1 in the first printing mode (see FIG. 15A).

In S560, the operation mode of the print process is switched to the second printing mode. Particularly, V2 (<V1) is set to the voltage value of the transfer voltage, T2 (<T1) is set to the heating temperature of the heating roller 91, L2 (<L1) is set to the laser power of the scanner unit 70, C2 (<Ci) is set to the conveying speed of the sheet (rotation speed of the motor 131). That is, when it is determined that the resistance value of the transfer roller 80 exceeds the predetermined reference limiting value (when the transfer roller 80 is deteriorated), the operation mode of the print process is set to the second printing mode.

As explained above, in the laser printer of the present embodiment, before starting the operation of printing an image on a sheet, a transfer voltage is applied to the transfer roller 80 under the conditions for the first printing mode, so as to detect the current value I of the transfer current at the time (S510, S520). When it is determined that the detected current value I does not fall below the reference current value Ir (the resistance value of the transfer roller 80 does not exceed the reference limiting value) (S530: NO), the operation mode of the print process is set to the first printing mode and the printing operation is performed (S540, S550). That is, if the resistance value of the transfer roller 80 does not exceed the reference limiting value, the standard printing operation is performed. On the other hand, when it is determined that the detected current value I falls below the reference current value Ir (the resistance value of the transfer roller 80 exceeds the reference limiting value) (S530: YES), the operation mode of the print process is set to the second printing mode and the printing operation is performed (S560, S570). That is, if the resistance value of the transfer roller 80 exceeds the reference limiting value, the printing operation is performed under such conditions that inhibit defective transfer which may be caused by the high resistance value of the transfer roller 80. Therefore, according to the present laser printer, the same effect as mentioned for the laser printer of the first embodiment can be obtained.

[Variation of the Second Embodiment]

In the laser printer of the aforementioned second embodiment, in the second printing mode, constant voltage control is performed using the voltage value V2 which is lower than the voltage value V1 of the transfer voltage in the first printing mode. However, this is not the only way. For example, in the second printing mode, the constant current control may be performed.

That is, the second printing mode in the present variation is different from the first printing mode in the following respects (f1) to (f4).

(f1): The constant current control is performed in which the transfer current having a constant current value is passed to the transfer roller 80.

Figure 17A:
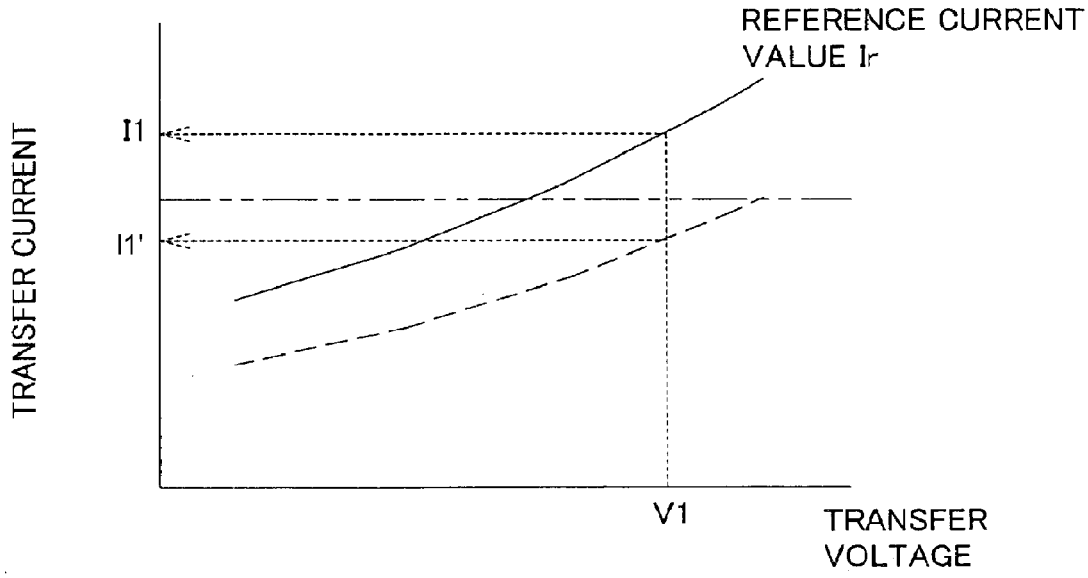
FIGS. 17A and 17B are explanatory views illustrating the second printing mode in a variation of the second embodiment.
Figure 17B:
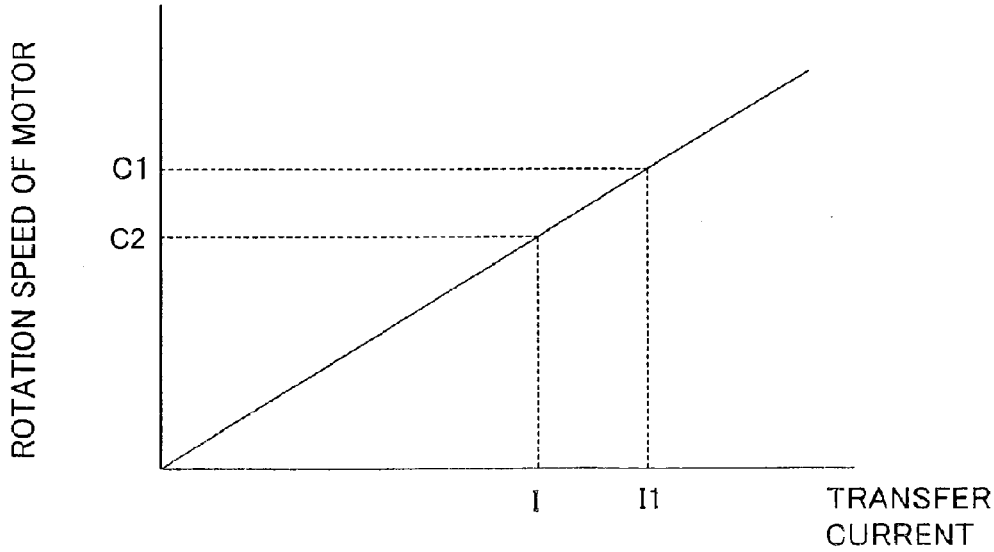

(f2): The conveying speed of the sheet (rotation speed of the motor 131) is set low. That is, as shown in FIG. 17A, as the resistance value of the transfer roller 80 is increased (from a curved solid line to a curved dotted line in FIG. 17A), the current value of the transfer current passed when the transfer voltage having the certain voltage value V1 is applied is decreased (from I1 to I1'). As the current value of the transfer current is excessively lowered, transfer of the toner image from the surface of the photosensitive drum 51 onto the sheet is not sufficiently performed, and thus, defective transfer may occur. As shown in FIG. 17B, the lower the current value of the transfer current, the lower the conveying speed of the sheet is required in transferring a certain toner image (the transfer time is required to be long). Accordingly, while the current value of the transfer current is decreased (from I1 to I), the conveying speed (rotation speed of the motor 131) of the sheet is decreased (from Cl to C2) so that the transfer time becomes long. Thus, it is possible to inhibit defective transfer due to insufficient transfer of the toner image even if the current value of the transfer current is low.

(f3): For the same reason as mentioned in the first embodiment, the laser power from the scanner unit 70 is set low.

(f4): For the same reason as mentioned in the first embodiment, the heating temperature by the heating roller 91 is set low.

Figure 18:
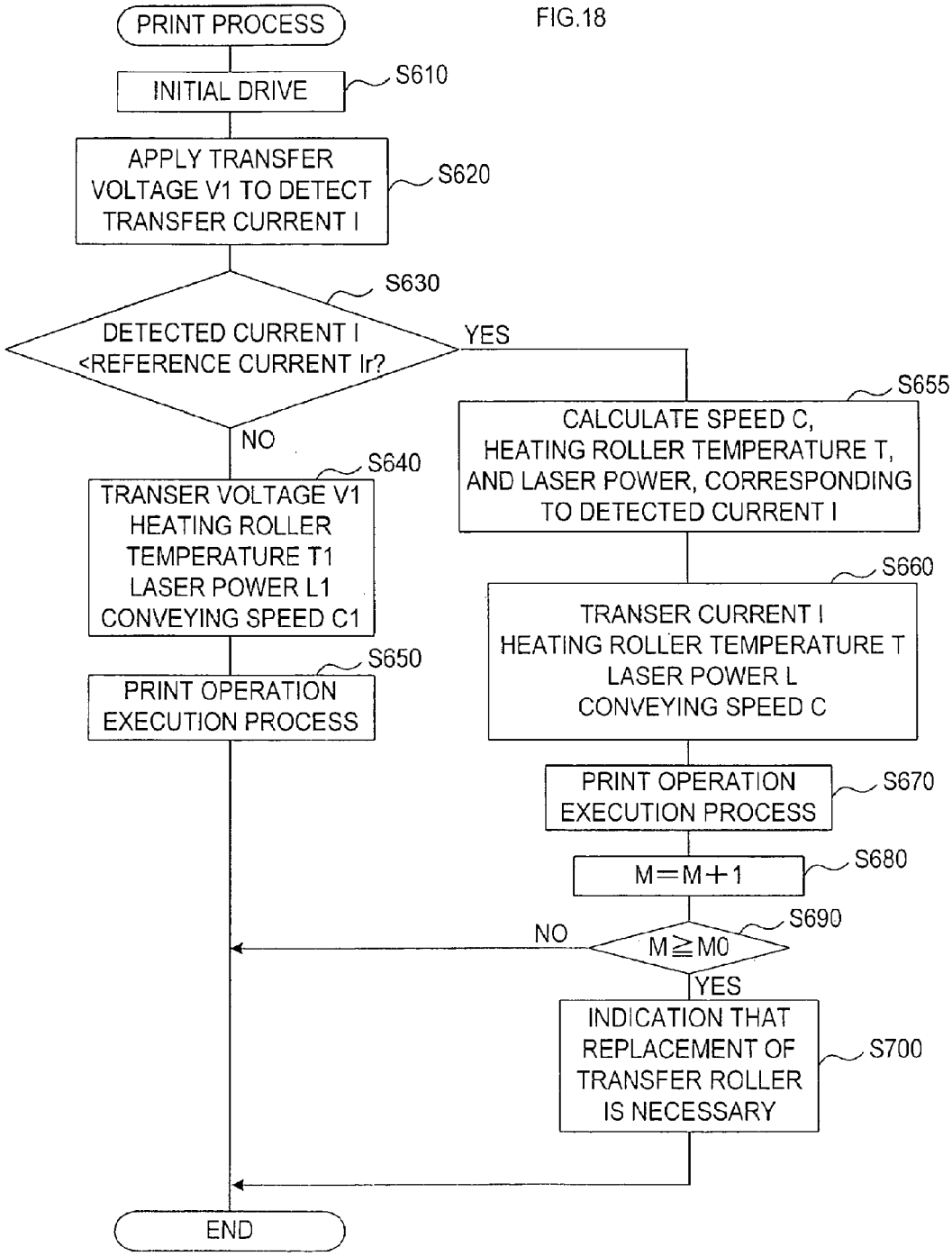
FIG. 18 is a flowchart of a print process in the variation of the second embodiment.

From now on, a print process according to the present variation is explained by way of a flowchart in FIG. 18. Steps of S610 to S650, and S670 to S700 in this print process are the same as the steps of S510 to S550, and S570 to S600 in the print process according to the aforementioned second embodiment (FIG. 16). Therefore, the descriptions for those steps are not repeated.

In S630, when it is determined that the current value I of the transfer current detected in S620 falls below the predetermined reference current value Ir, the process moves to S655, where a conveying speed (rotation speed of the motor 131) C of the sheet corresponding to the current value I detected in S620 is calculated. The conveying speed C calculated herein is a value lower than the conveying speed C1 in the first printing mode (see FIG. 17B). Then, a heating temperature T of the heating roller 91 and a laser power L of the scanner unit 70, which correspond to the calculated conveying speed C, are calculated.

In S660, the operation mode of the printing operation is switched to the second printing mode. Particularly, the value T2 (<T1) calculated in S655 is set to the heating temperature of the heating roller 91, the value L (<L1) calculated in S655 is set to the laser power of the scanner unit 70, the value C (<C1) calculated in S655 is set to the conveying speed of the sheet (rotation speed of the motor 131).

In the constitution of the present variation, when it is determined that the resistance value of the transfer roller 80 exceeds the reference limiting value, the constant current control using the detected current value I is performed. Therefore, even if the transfer roller 80 has a high resistance value, conditions can be provided which is based on the maximum current value within a range in which electric discharge can be inhibited. Accordingly, deterioration in performance (deterioration in printing performance in the present variation, and deterioration in image density in the case of the second and third variations of the first embodiment in which the toner image is thinned) of the laser printer caused by switching to the second printing mode can be inhibited to a minimum.

The present invention is not limited to the above described embodiments. The present invention can be practiced in various ways without departing from the scope of the invention.

For instance, in the laser printers of the aforementioned embodiments, when the number of times it is determined that the resistance value of the transfer roller 80 exceeds the predetermined reference limiting value has reached M0, the message indicating that the replacement of the transfer roller 80 is necessary is displayed. However, for example, the message may be displayed at the time when it is determined the first time that the resistance value of the transfer roller 80 exceeds the predetermined reference limiting value. Alternatively, the laser printer of the present invention can be designed in such a manner that no such indication is performed.

What is claimed is:

1. An image forming apparatus that performs an image forming operation for forming an image on a recording medium, comprising:

a photosensitive body;

a charging device that charges a surface of the photosensitive body;

an exposing device that exposes the surface of the photosensitive body charged by the charging device so as to form an electrostatic latent image;

a developing device that develops, using developer, the electrostatic latent image formed on the surface of the photosensitive body by the exposing device so as to form a developer image;

a transfer device that transfers the developer image formed by the developing device onto the recording medium;

a transfer controller that applies a transfer voltage to the transfer device so that a transfer current is passed to transfer the developer image onto the recording medium;

a resistance determiner that determines whether a resistance value of the transfer device exceeds a predetermined reference limiting value;

and an operation mode switcher that switches an operation mode of the image forming operation, when it is determined by the resistance determiner that the resistance value of the transfer device exceeds the reference limiting value, from a first image forming mode that is the operation mode before it is determined that the resistance value exceeds the reference limiting value, to a second image forming mode that provides better protection against defective transfer by the transfer device than the first image forming mode.

2. The image forming apparatus according to claim 1, wherein the transfer controller is designed, at least in the first image forming mode, for constant current control in which the transfer voltage is applied so that the transfer current having a constant current value is passed to the transfer device, and the second image forming mode has conditions to set the current value of the transfer current lower than the current value in the first image forming mode and to inhibit defective transfer caused by the lowered current value of the transfer current.

3. The image forming apparatus according to claim 2, wherein the resistance determiner determines that the resistance value of the transfer device exceeds the reference limiting value, when the voltage value of the transfer voltage required for passing a transfer current having a constant current value to the transfer device exceeds a determination voltage value.

4. The image forming apparatus according to claim 3, wherein the transfer controller is designed, in the second image forming mode, for constant voltage control in which the transfer voltage having the determination voltage value is applied to the transfer device.

5. The image forming apparatus according to claim 2, wherein the second image forming mode has conditions to set a transfer time in the image forming operation longer than a transfer time in the first image forming mode.

6. The image forming apparatus according to claim 5, wherein the second image forming mode has conditions to set a transfer speed of the recording medium lower than a transfer speed in the first image forming mode.

7. The image forming apparatus according to claim 2, wherein the second image forming mode has conditions to set an absolute value of potential difference between potential of a part exposed by the exposing device on the surface of the photosensitive body and developing potential applied to the developing device smaller than an absolute value of the potential difference in the first image forming mode.

8. The image forming apparatus according to claim 7, wherein the second image forming mode has conditions to set an absolute value of the developing potential applied to the developing device smaller than an absolute value of developing potential in the first image forming mode.

9. The image forming apparatus according to claim 7, wherein the second image forming mode has conditions to set a degree of exposure by the exposing device lower than a degree of exposure in the first image forming mode.

10. The image forming apparatus according to claim 1, wherein the transfer controller is designed, at least in the first image forming mode, for constant voltage control in which the transfer voltage having a constant voltage value is applied to the transfer device, and the second image forming mode has conditions to inhibit defective transfer caused by the lowered current value of the transfer current.

11. The image forming apparatus according to claim 10, wherein the resistance determiner determines that the resistance value of the transfer device exceeds the reference limiting value, when the current value of the transfer current passed by application of a transfer voltage having a constant voltage value to the transfer device falls below a determination current value.

12. The image forming apparatus according to claim 11, wherein the transfer controller is designed, in the second image forming mode, for constant current control in which the transfer voltage is applied so as to pass to the transfer device the transfer current having the current value passed by application of the transfer voltage having the constant voltage value.

13. The image forming apparatus according to claim 1, further comprising a fixing device that heats the developer image transferred onto the recording medium by the transfer device so as to fix the developer image on the recording medium, wherein conditions for setting a heating temperature by the fixing device in the second image forming mode are set different from conditions for setting a heating temperature in the first image forming mode.

14. The image forming apparatus according to claim 1, wherein the transfer device is an ionic conductive transfer roller.

15. The image forming apparatus according to claim 1, further comprising a replacement determiner that determines whether replacement of the transfer device is necessary based on determination by the resistance determiner, and a notifier that gives notice when it is determined by the replacement determiner that the replacement of the transfer device is necessary.

* * * * *